US010201976B2

(12) United States Patent
Mizutani

(10) Patent No.: US 10,201,976 B2
(45) Date of Patent: Feb. 12, 2019

(54) INKJET PRINTER

(71) Applicant: BROTHER KOGYO KABUSHIKI KAISHA, Nagoya, Aichi (JP)

(72) Inventor: Shunsuke Mizutani, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/230,663

(22) Filed: Aug. 8, 2016

(65) Prior Publication Data

US 2016/0339705 A1 Nov. 24, 2016

Related U.S. Application Data

(62) Division of application No. 14/865,123, filed on Sep. 25, 2015, now Pat. No. 9,409,427.

(30) Foreign Application Priority Data

Sep. 25, 2014 (JP) ..... 2014-195384

(51) Int. Cl.
*B41J 2/165* (2006.01)
*B41J 25/00* (2006.01)
(Continued)

(52) U.S. Cl.
CPC ..... *B41J 2/16505* (2013.01); *B41J 2/16508* (2013.01); *B41J 2/16511* (2013.01);
(Continued)

(58) Field of Classification Search
CPC .... B41J 2/16505; B41J 19/202; B41J 23/025; B41J 2/16508; B41J 2/16511; B41J 25/001
See application file for complete search history.

(56) References Cited

U.S. PATENT DOCUMENTS

2005/0068364 A1* 3/2005 Kayanaka ..... B41J 2/165 347/23
2006/0274128 A1* 12/2006 Tsukada ..... B41J 2/17566 347/70
(Continued)

FOREIGN PATENT DOCUMENTS

JP H06-219006 A 8/1994
JP 2014-015024 A 1/2014

OTHER PUBLICATIONS

Japanese Official Action dated May 8, 2018 received in related application JP 2014-195384 together with an English language translation.

*Primary Examiner* — Yaovi M Ameh
(74) *Attorney, Agent, or Firm* — Scully, Scott, Murphy & Presser, P.C.

(57) ABSTRACT

An inkjet printer has a printing head, a sheet conveying mechanism, a carriage mounting a printing head and configured to be reciprocally movable in a printing area and non-printing area. A cap is provided to be movable between a capping position an uncap position. A controller of the inkjet printer is configured to execute a printing process, a standby process, and a capping process in which the controller causes the carriage to move to the non-printing area and moves the cap from the uncap position to the capping position. The controller causes the carriage to move into the printing area when the next printing command is received after the standby process is finished and before the carriage moving process has been completed.

4 Claims, 15 Drawing Sheets

(51) Int. Cl.
*B41J 19/20* (2006.01)
*B41J 23/02* (2006.01)

(52) U.S. Cl.
CPC ..... *B41J 19/202* (2013.01); *B41J 23/025* (2013.01); *B41J 25/001* (2013.01)

(56) References Cited

U.S. PATENT DOCUMENTS

| | | | | |
|---|---|---|---|---|
| 2009/0035019 | A1 | 2/2009 | Koga | |
| 2013/0257987 | A1 | 10/2013 | Wakakusa | |
| 2015/0049138 | A1* | 2/2015 | Aoyama | B41J 29/393 347/16 |

* cited by examiner

INKJET PRINTER

This application is a divisional application of U.S. Ser. No. 14/865,123 filed on Sep. 25, 2015, and claims priority under 35 U.S.C. § 119 from Japanese Patent Application No. 2014-195384 filed on Sep. 25, 2014. The entire subject matter of each application is incorporated herein by reference.

BACKGROUND

Technical Field

The present disclosures relate to an inkjet printer having a cap used to cover nozzles of a recording head thereof.

Related Art

Conventionally, an inkjet printer having a cap, which is used to prevent drying of nozzles of a printing head and/or adhering of dust to the nozzles, has been known. For example, such a cap is provided at one end portion within a movable range of a carriage, which mounts the printing head. Typically, a driving motor rotates in a particular direction to execute a series of steps to move up/down the cap in order to cover/uncover the nozzles.

SUMMARY

When the cap is being moved to cover the nozzles (hereinafter, an operation or condition of the cap covering the nozzles will be referred to as capping), in order to re-start a printing operation, the motor is further rotated in the particular direction to complete the series of steps to re-position the cap to an uncovering position. Such an operation requires time. Therefore, the capping is not started immediately after completion of a print job, but started when a next print job has not been received for a particular period of time. Unless the nozzles become dried, which cause malfunction of ink ejecting performance, it is advantageous to await the next print job without executing the capping in terms of waiting time.

According to aspects of the disclosures, there is provided an inkjet printer, which has a printing head configured to eject ink drops from multiple nozzles to form an image on a printing sheet, a conveying mechanism configured to convey the printing sheet, a carriage mounting a printing head and configured to be reciprocally movable in a particular direction and movable within both a printing area at which the printing head faces the printing sheet conveyed by the conveying mechanism and non-printing area outside the printing area in the particular direction, a cap moving mechanism arranged in the non-printing area and configured to move a cap capable of covering the multiple nozzles formed on the printing head between a capping position at which the cap covers the multiple nozzles and an uncap position at which the cap does not cover the multiple nozzles, a driving motor, a driving force transmitting mechanism arranged in the non-printing area and configured to switch destinations to which the driving force of the driving motor is to be transmitted, and a controller configured to control at least movement of the carriage and an operation of the driving motor. The driving force transmitting mechanism has a displaceable gear which is movable in the particular direction with being in a state where the driving motor can be transmitted to the displaceable gear, the displaceable gear being urged in a first direction which is a direction from the non-printing area to the printing area in the particular direction, multiple drive gears arranged along the particular direction so as to be engageable with the displaceable gear, the multiple drive gears including a first drive gear configured to transmit a driving force to a conveying element and a second drive gear arranged on the first direction side with respect to the first drive gear, a pressing member arranged to be movable in the particular direction, the pressing member being arranged on the first direction side with respect to the movable gear, the pressing member being urged in a second direction which is a direction from the printing area to the non-printing area in the particular direction so that the pressing member presses to urge the displaceable gear in the second direction with an urging force which is stronger the urging force of the displaceable gear in the first direction, the pressing member being movable in the first direction in association with movement of the carriage in the first direction, a regulation mechanism configured to regulate movement of the pressing member, the regulation mechanism allowing movement of the pressing member in the first direction when the pressing member is located at a second position which is on the first direction side with respect to a first position at which the pressing member presses the displaceable gear in the second direction to make the displaceable gear engage with the first drive gear, the regulation mechanism preventing movement of the displaceable gear in the second direction, the regulation member allowing movement of the pressing member located at a third position which is on the first direction side with respect to the second position to move in the second direction to return the first position, and the displaceable gear being movable to a position at which the displaceable gear is engageable with the second drive gear, by the urging force in the first direction, when the pressing member is located at the second position. Further, the controller is configured to execute a printing process in which the controller causes the carriage to move within the printing area, a standby process in which the controller causes the carriage to stop within the printing area for a particular period after a printing operation is finished and causes the carriage to wait until receipt of a next printing command, a carriage moving process in which the controller causes the carriage to move in the first direction toward the cap moving mechanism when the next printing command has not been received within the particular period, and a capping process in which the controller moves the cap from the uncap position to the capping position, the capping process being executed after the carriage moving process. The controller causes the carriage to move in the second direction when the next printing command is received after the standby process is finished and before the carriage moving process has been completed. Further, when the next printing command is received after the carriage moving process is completed, the controller determines whether the pressing member is located at the third position and moves the carriage in the first direction so that the pressing member is once located at the third position when the pressing member is not located at the third position, and thereafter, moves the carriage in the second direction. Furthermore, when the pressing member is located at the third position, the controller causes the carriage to move in a second direction which is opposite to the first direction.

According to further aspects of the disclosures, there is provided an inkjet printer, which has a printing head configured to eject ink drops from multiple nozzles, a conveying mechanism configured to convey a sheet, a carriage mounting a printing head and configured to be reciprocally movable in a particular direction and movable within both a printing area at which the printing head faces the sheet conveyed by the conveying mechanism and a non-printing area outside the printing area in the particular direction, a cap moving mechanism arranged in the non-printing area and configured to move a cap capable of covering the multiple nozzles formed on the printing head between a capping position at which the cap covers the multiple nozzles and an uncap position at which the cap does not cover the multiple nozzles, a driving motor, a driving force transmitting mechanism arranged in the non-printing area and configured to switch destinations to which the driving force of the driving motor is to be transmitted, and a controller configured to control at least movement of the carriage and an operation of the driving motor. The driving force transmitting mechanism has a displaceable gear which is movable in the particular direction with being in a state where the driving motor can be transmitted to the displaceable gear, multiple drive gears arranged along the particular direction so as to be engageable with the displaceable gear, the multiple drive gears including a first drive gear configured to transmit a driving force to a conveying element and a second drive gear arranged on a first direction, which is a direction from the printing area to the non-printing area in the particular direction, side with respect to the first drive gear, a switching lever arranged movable in the particular direction and protruded to the non-printing area of the carriage, the switching lever being configured to move in the first direction, in the particular direction, as is contacted with the carriage moving in the first direction, the switching lever being movable at least between a first position and a second position which is on the first direction side with respect to the first position. The displaceable gear is movable to an engageable position to engage with the first drive gear when the switching lever is located at the first position, while movable to another engageable position to engage with the second drive gear when the switching lever is located at the second position. Further, the controller is configured to execute a printing process in which the controller causes the carriage to move within the printing area, a standby process in which the controller causes the carriage to stop within the printing area for a particular period after a printing operation is finished and causes the carriage to wait until receipt of a next printing command, a carriage moving process in which the controller causes the carriage to move in the first direction toward the cap moving mechanism when the next printing command has not been received within the particular period of the standby process, and a capping process in which the controller causes the cap to move from the uncap position to the capping position, the capping process being executed after the carriage moving process. Further, the controller causes the carriage to move in the second direction opposite to the first direction when the next printing command is received after the standby process is finished and before the carriage moving process has been completed.

According to further aspects of the disclosures, there is provided an inkjet printer, which has a printing head configured to eject ink drops from multiple nozzles, a conveying mechanism configured to convey a sheet, a carriage mounting a printing head and configured to be reciprocally movable in a particular direction and movable within both a printing area at which the printing head faces the sheet conveyed by the conveying mechanism and a non-printing area outside the printing area in the particular direction, a cap moving mechanism arranged in the non-printing area and configured to move a cap capable of covering the multiple nozzles formed on the printing head between a capping position at which the cap covers the multiple nozzles and an uncap position at which the cap does not cover the multiple nozzles, and a controller configured to control movement of the carriage. The controller is configured to execute a printing process in which the controller causes the carriage to move within the printing area, a standby process in which the controller causes the carriage to stop within the printing area for a particular period after a printing operation is finished and causes the carriage to wait until receipt of a next printing command, a carriage moving process in which the controller causes the carriage to move in a first direction, which is a direction from the printing area to the non-printing area in the particular direction, toward the cap moving mechanism when the next printing command has not been received within the particular period of the standby process, and a capping process in which the controller causes the cap to move from the uncap position to the capping position, the capping process being executed after the carriage moving process. Further, the controller causes the carriage to move in the second direction when the next printing command is received after the standby process is finished and before the carriage moving process has been completed.

BRIEF DESCRIPTION OF THE ACCOMPANYING DRAWINGS

Figure 4:
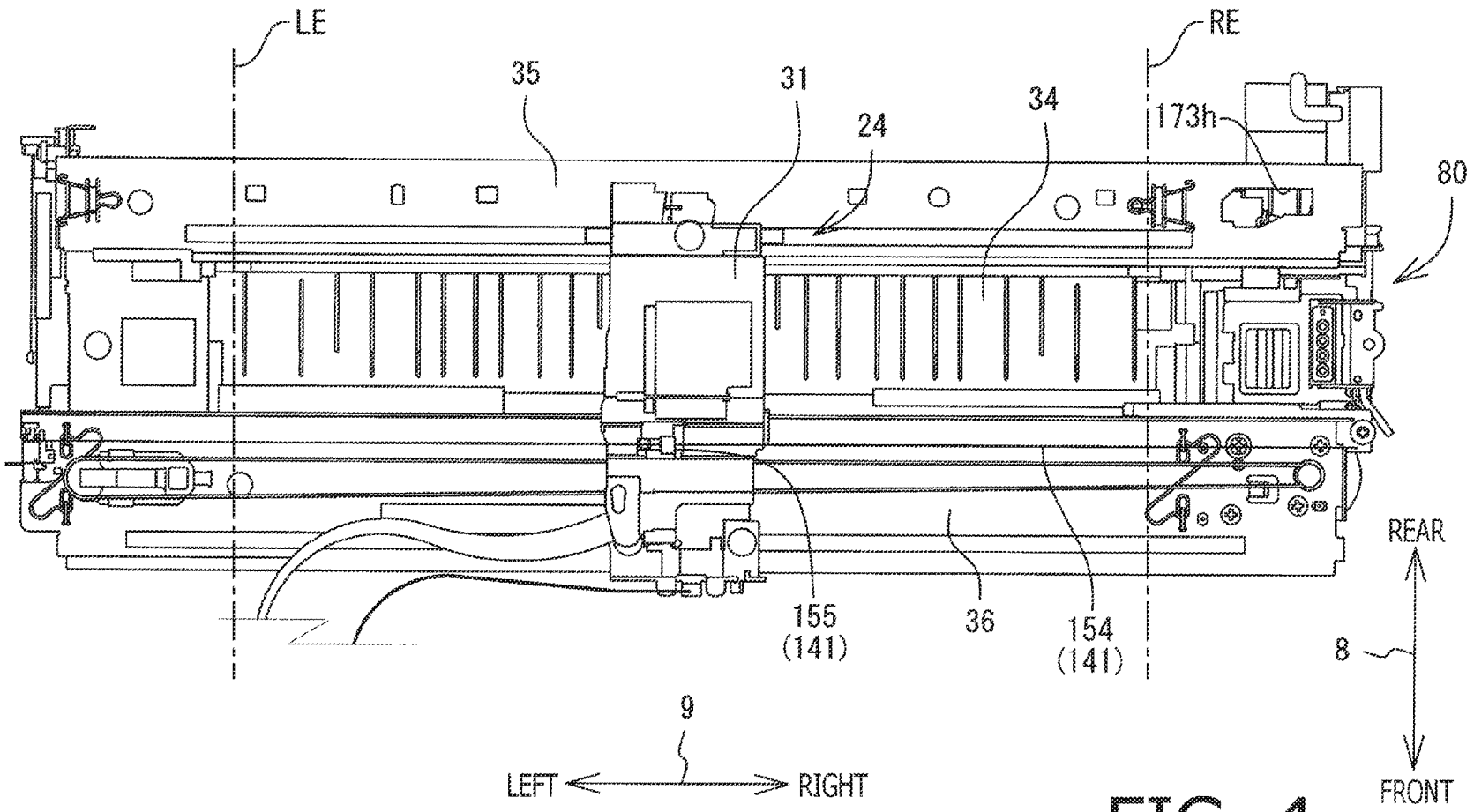

FIG. 4 a plan view showing a carriage and guide rails of the recording mechanism according to aspects of the disclosures.

Figure 5A:
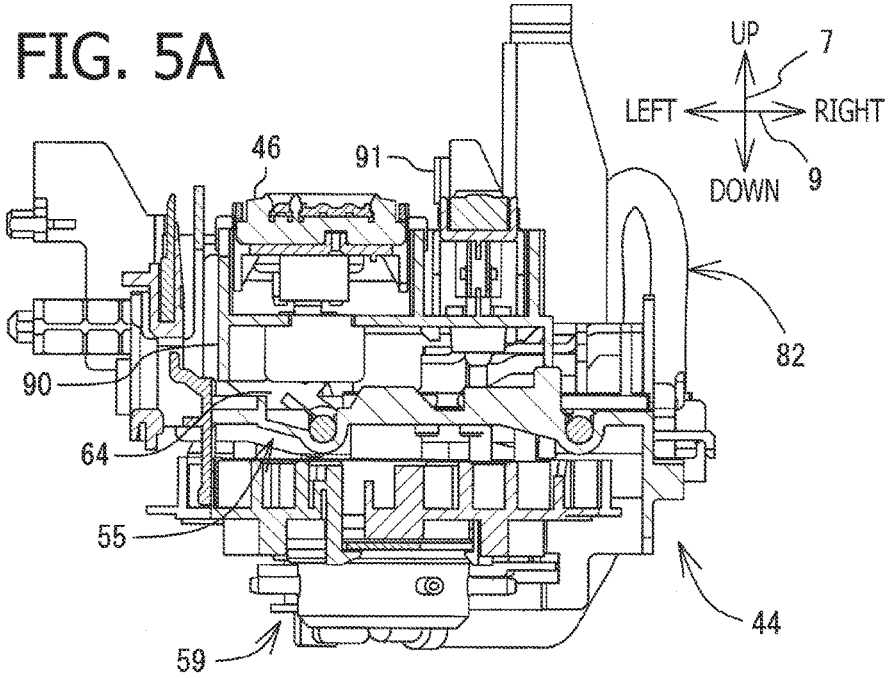
Figure 5B:
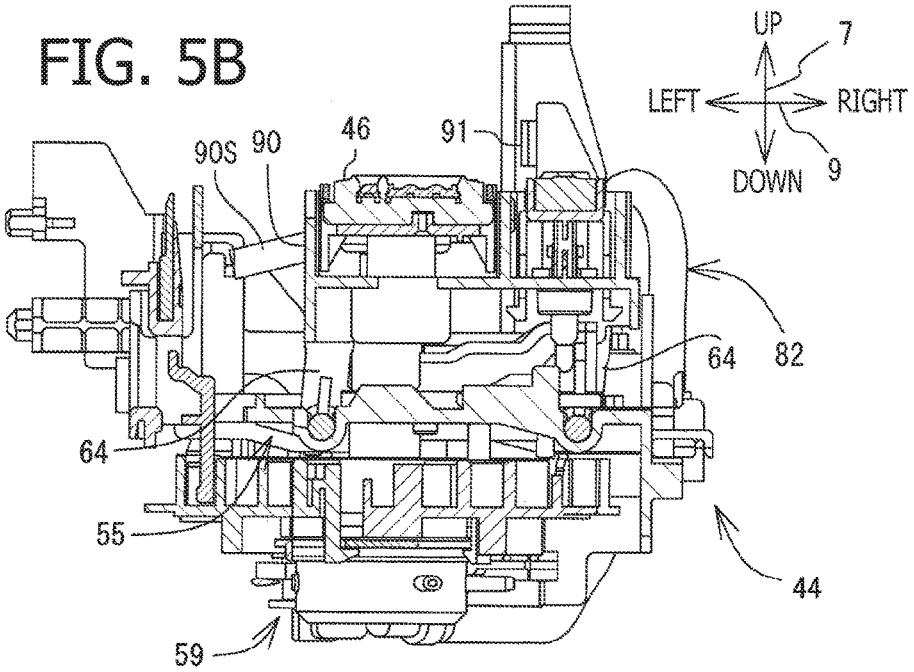

FIGS. 5A and 5B are cross-sectional views of a maintenance device according to aspects of the disclosures.

Figure 6:
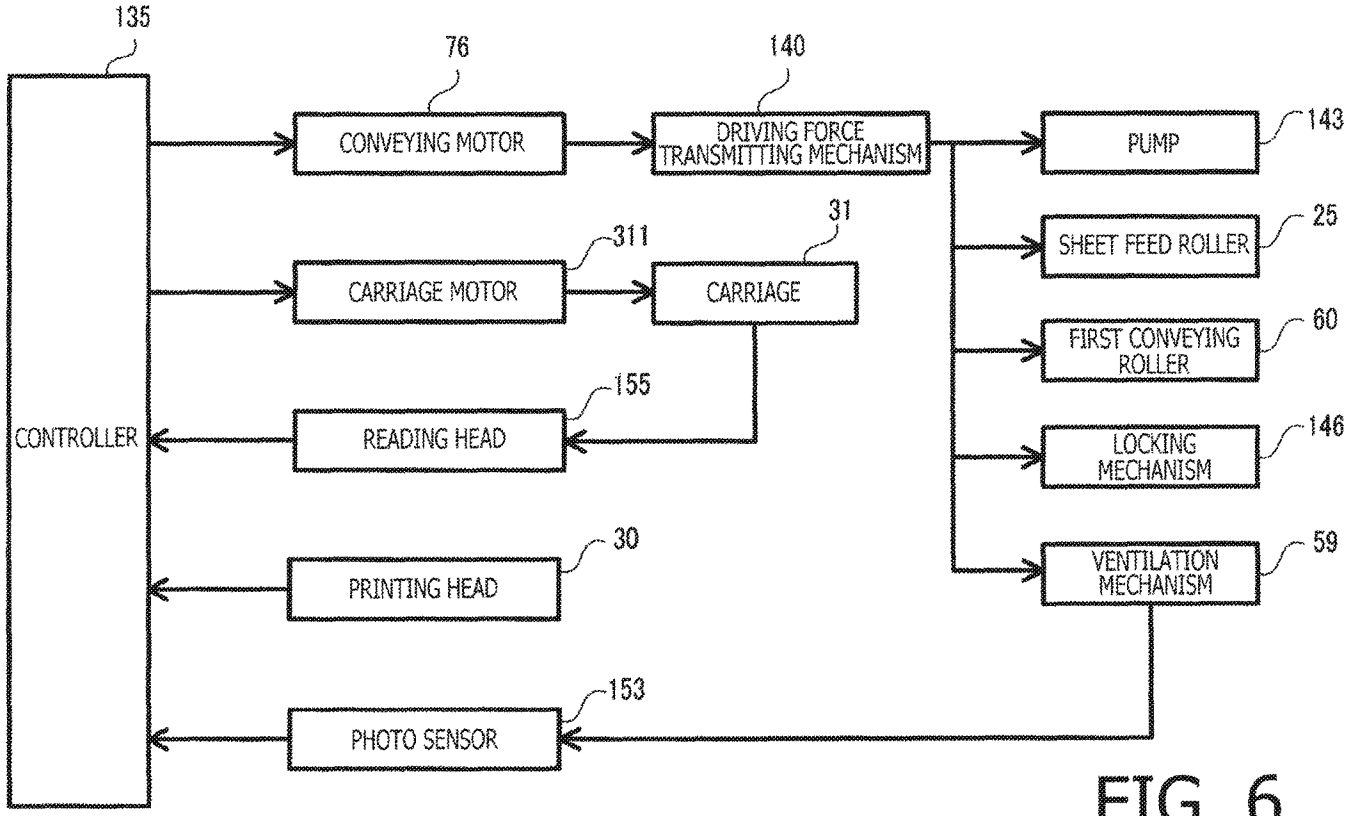

FIG. 6 is a block diagram illustrating a functional connection between a controller and components of the multi-functional peripheral according to aspects of the disclosures.

Figure 7A:
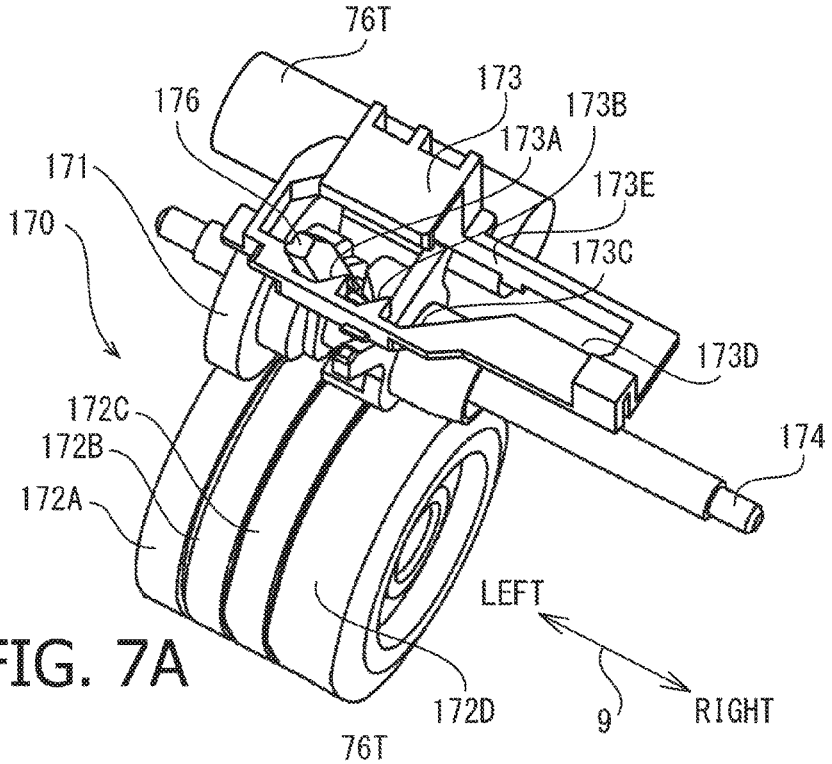

FIG. 7A is a perspective view of a gear switching mechanism in a first driving state according to aspects of the disclosures.

Figure 7B:
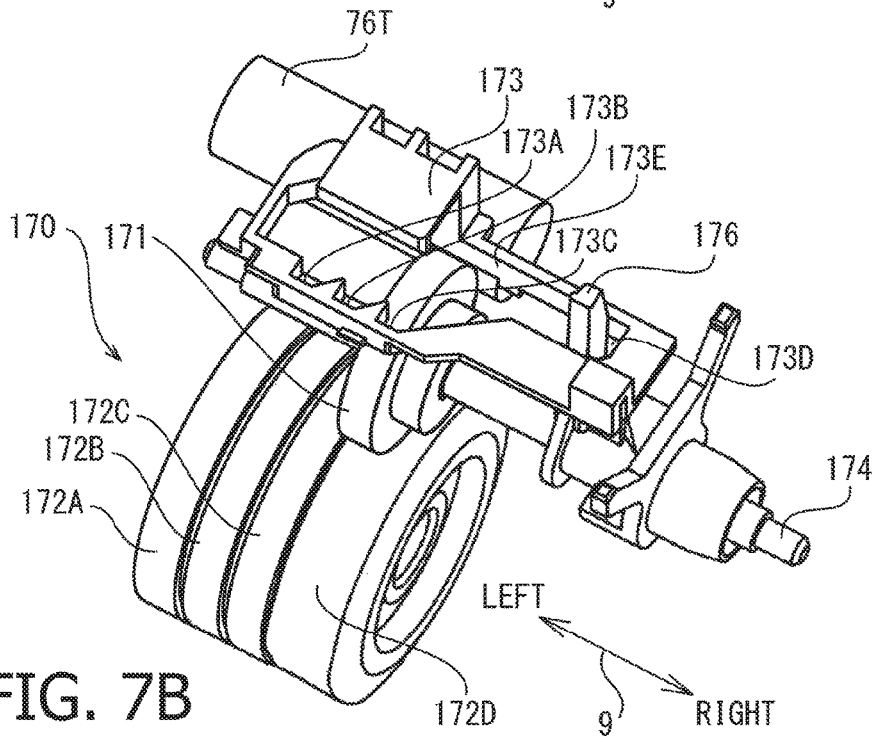

FIG. 7B is a perspective view of the gear switching mechanism in a second driving state according to aspects of the disclosures.

Figure 8A:
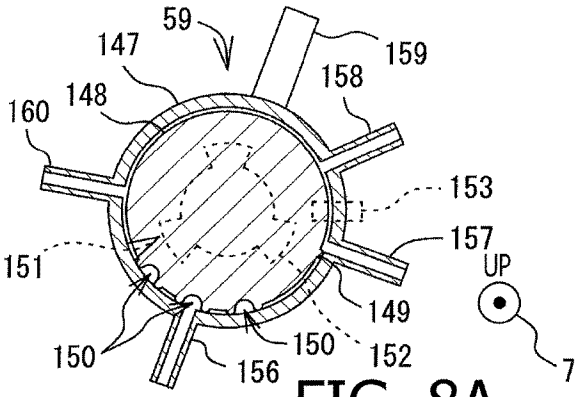

FIG. 8A is a cross-sectional view of a ventilation mechanism in a CO suction state according to aspects of the disclosures.

Figure 8B:
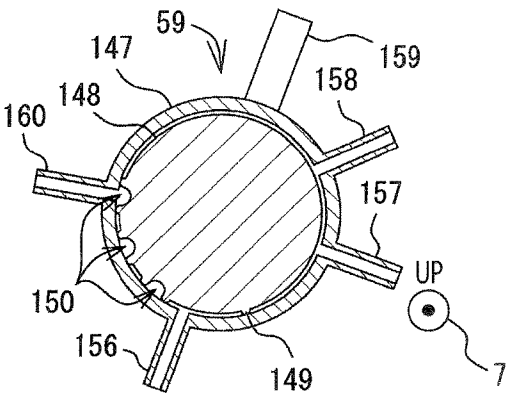

FIG. 8B is a cross-sectional view of a ventilation mechanism in an image recording state according to aspects of the disclosures.

Figure 8C:
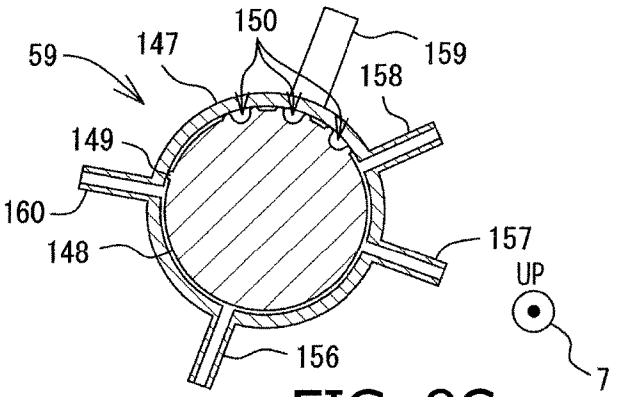

FIG. 8C is a cross-sectional view of a ventilation mechanism in air communicating state according to aspects of the disclosures.

Figure 8D:
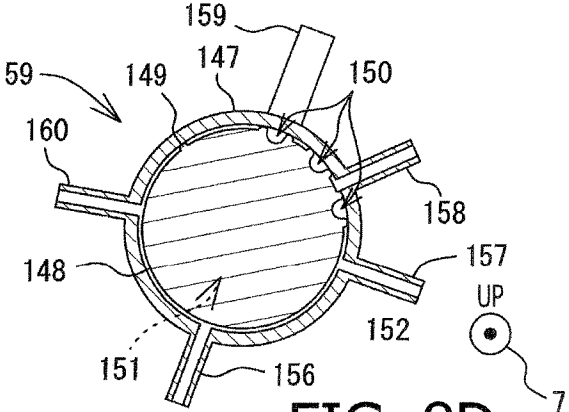

FIG. 8D is a cross-sectional view of a ventilation mechanism in a locking state according to aspects of the disclosures.

Figure 9:
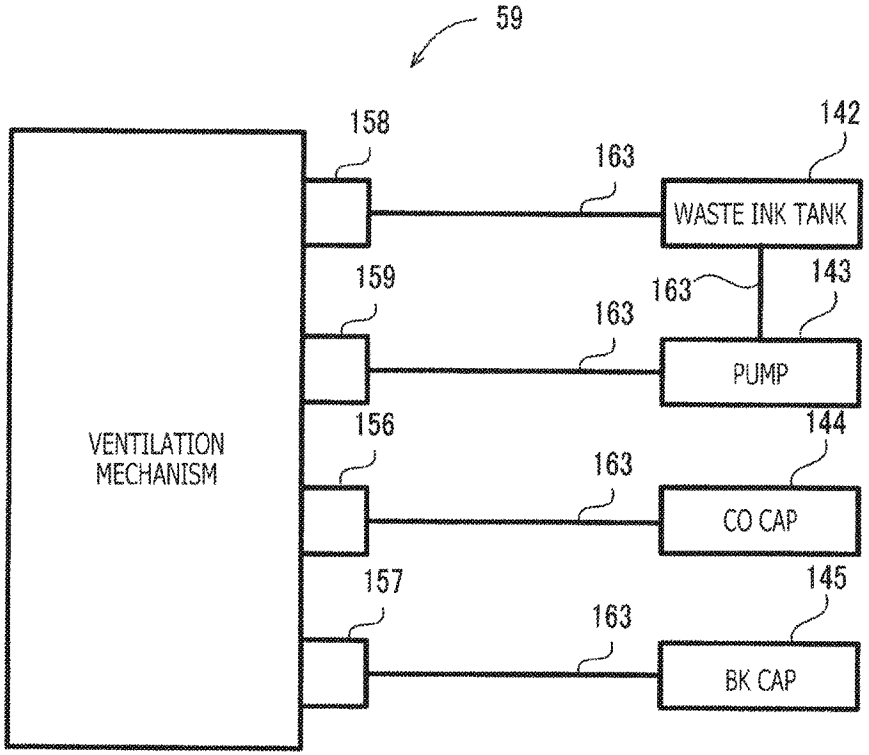

FIG. 9 schematically shows a connection among ports and components of the ventilation mechanism according to aspects of the disclosures.

Figure 10:
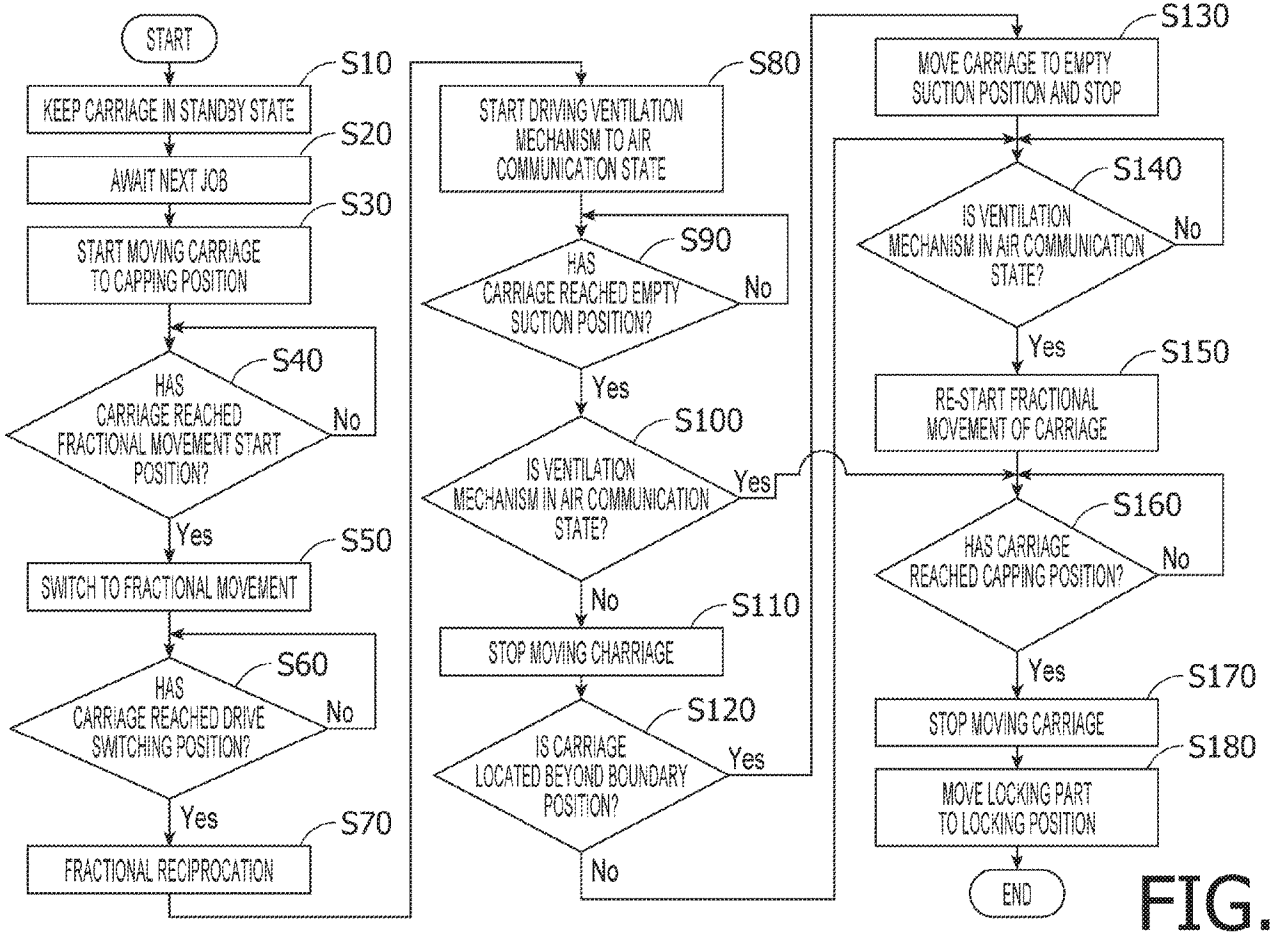

FIG. 10 is a flowchart illustrating a control of moving the carriage to a capping position.

Figure 11A:
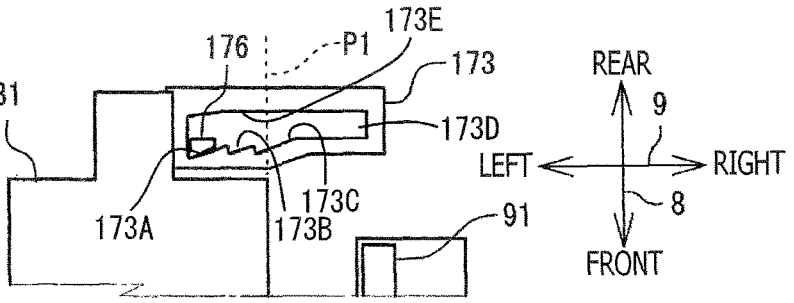

FIG. 11A schematically shows a portion around a lever holder and the carriage is located at a fractional movement start position.

Figure 11B:
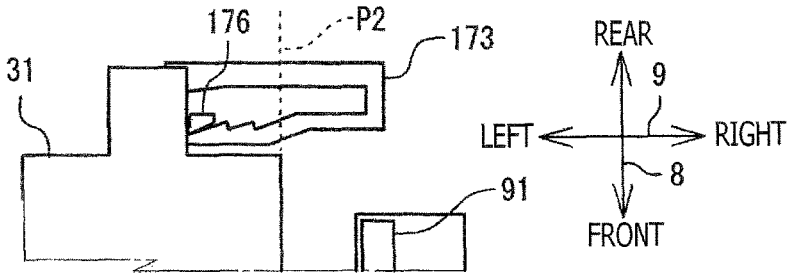

FIG. 11B schematically shows the portion around a lever holder and the carriage is located at a switching lever contact position.

Figure 11C:
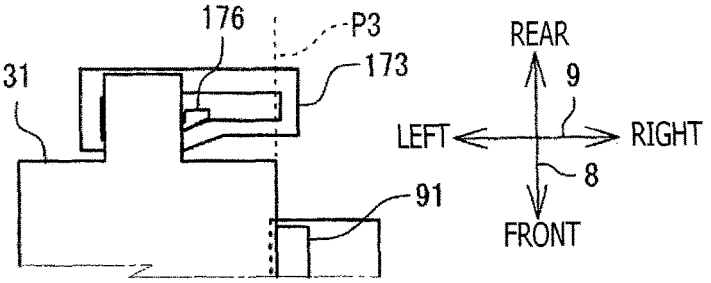

FIG. 11C schematically shows the portion around a lever holder and the carriage is located at a drive switching position.

Figure 11D:
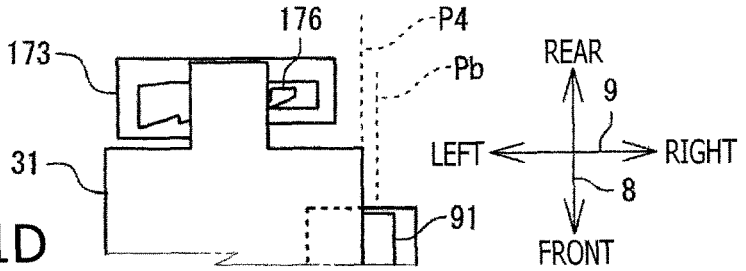

FIG. 11D schematically shows the portion around a lever holder and the carriage is located at an idle suction position.

Figure 11E:
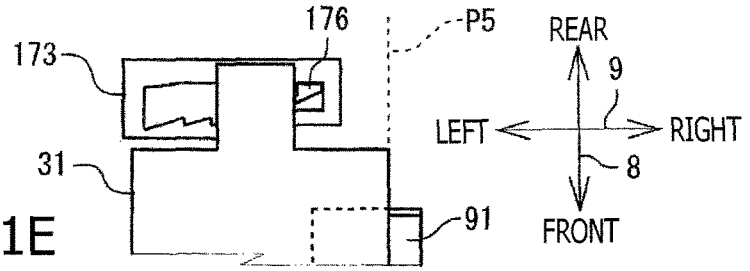

FIG. 11E schematically shows the portion around a lever holder and the carriage is located at a capping position.

Figures 12A, 12B, 12C:
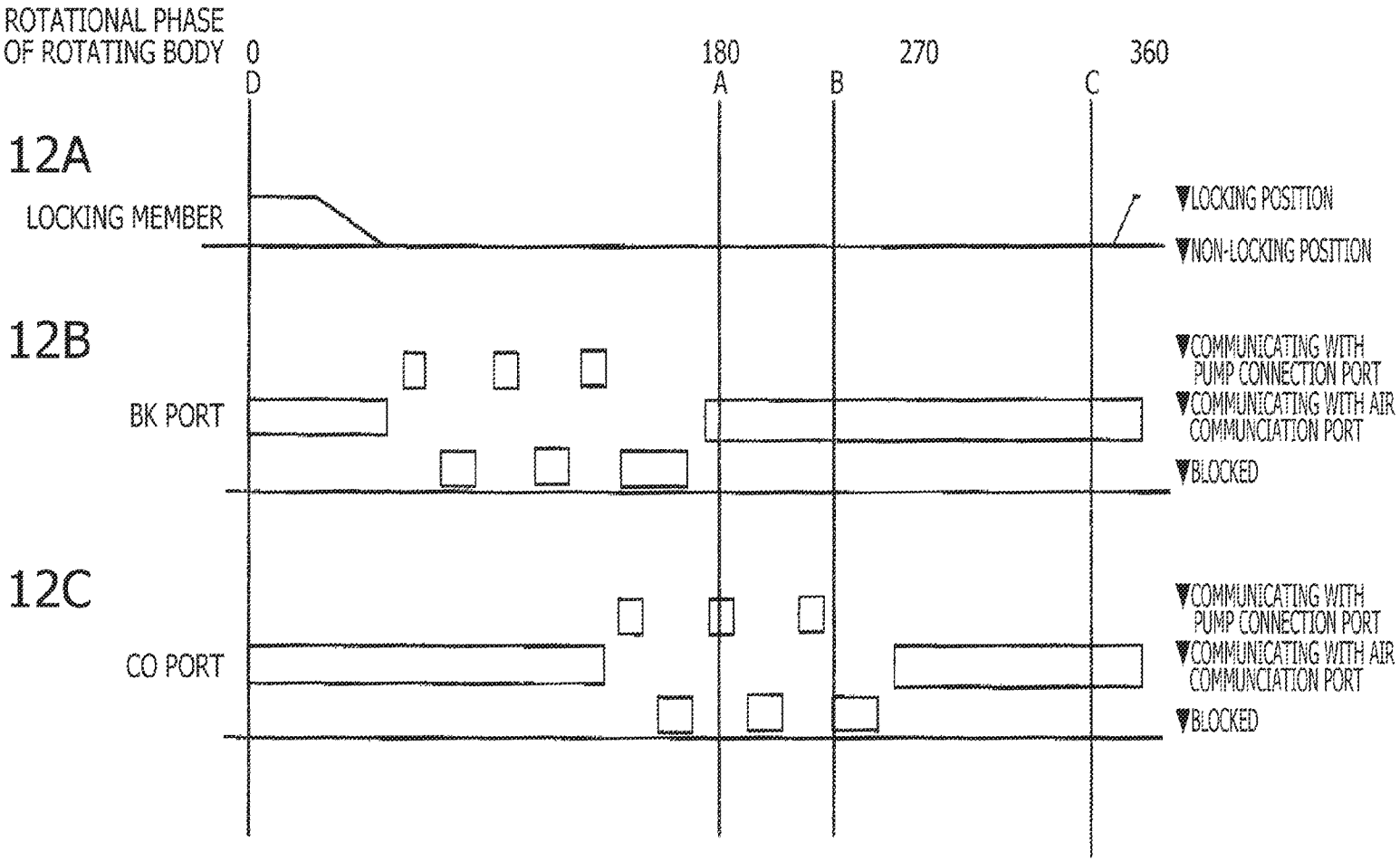

FIGS. 12A-12C show rotational phases of a rotating body and states of respective portions of the ventilation mechanism.

Figure 13:
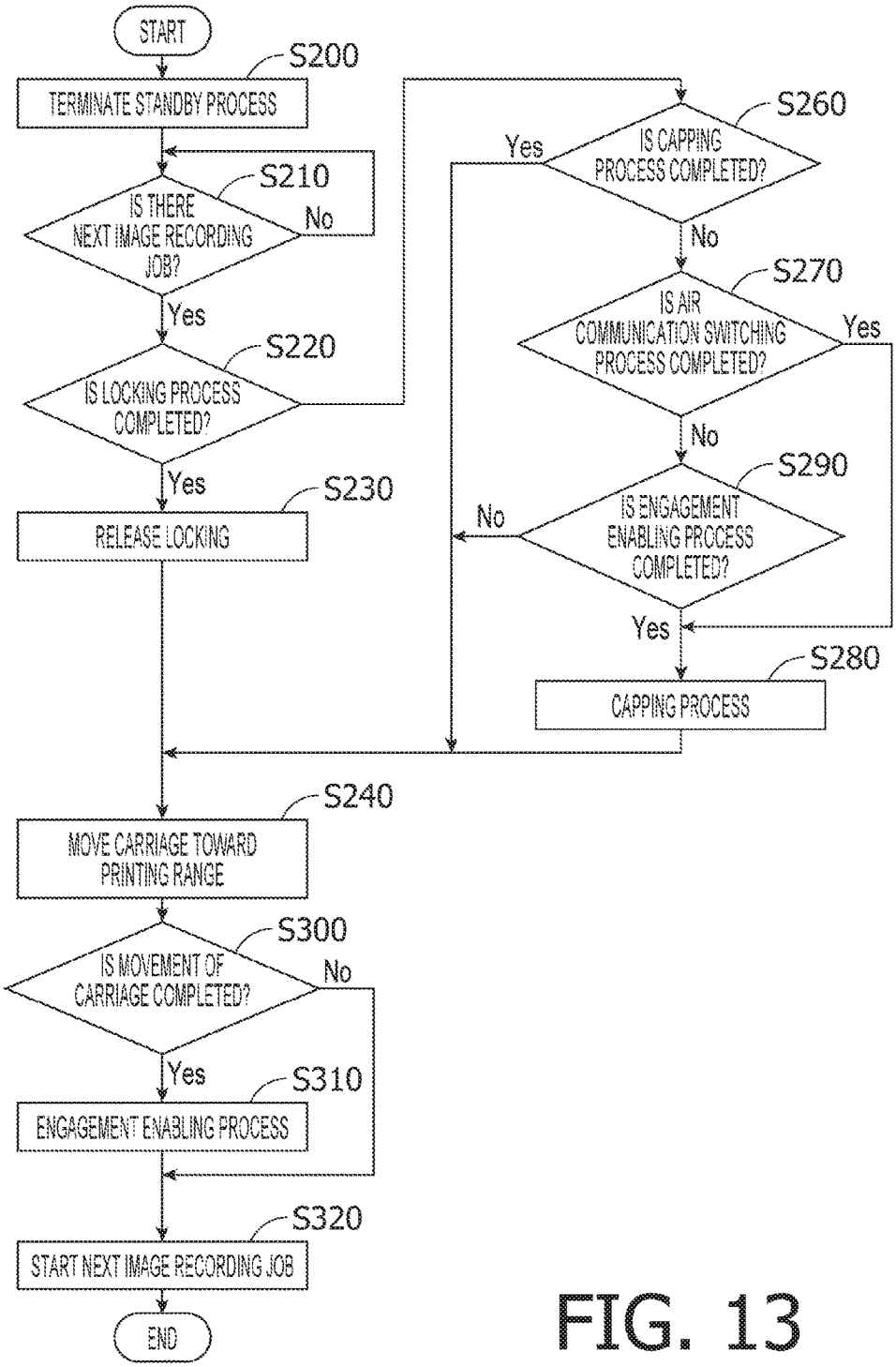

FIG. 13 shows a flowchart illustrating a control when an image recording job is generated after completion of standby process.

Figure 14B:
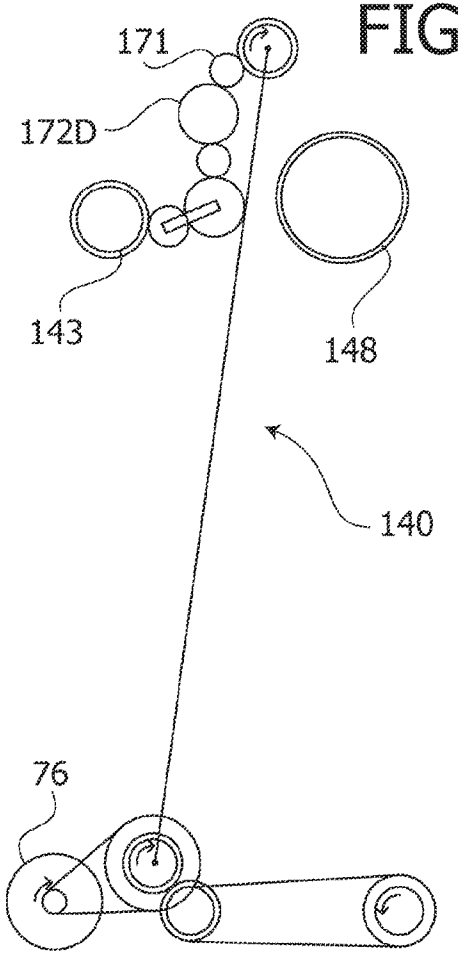
Figure 14A:
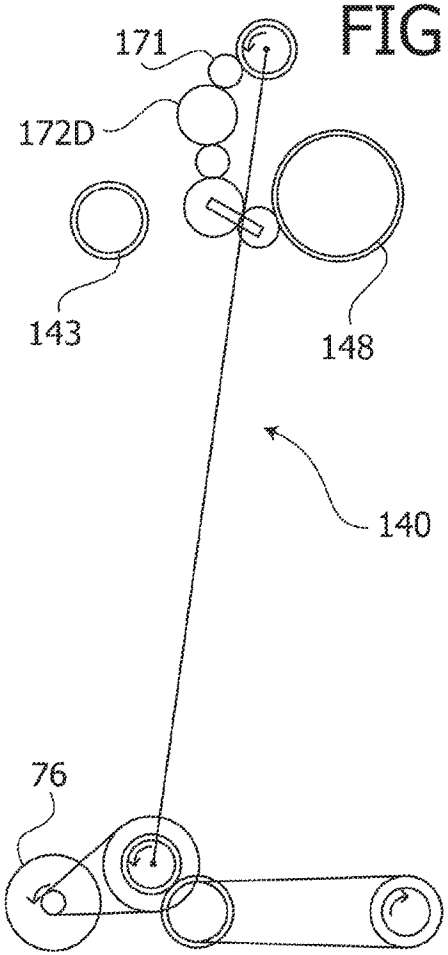

FIGS. 14A and 14B schematically show a relationship of a rotation direction of a conveying motor and operation status of the pump.

Figure 15B:
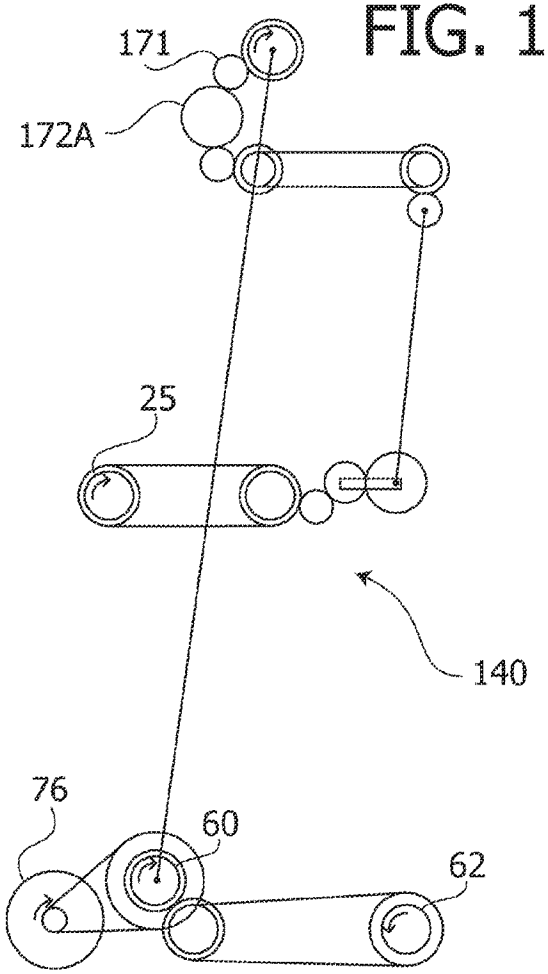
Figure 15A:
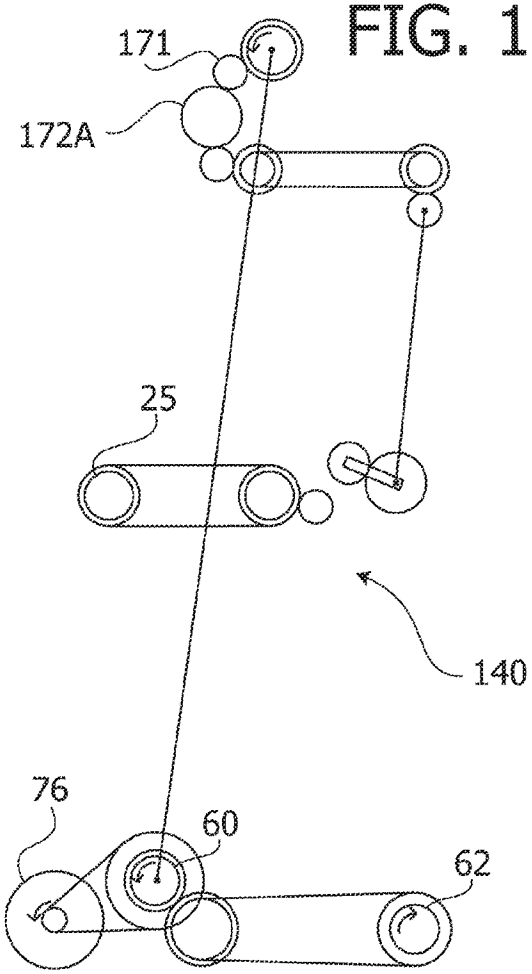

FIGS. 15A and 15B schematically show a relationship of a rotation direction of a conveying motor and operation of a drive force transmitting mechanism.

DETAILED DESCRIPTION

Hereinafter, referring to the accompanying drawings, an illustrative embodiment according to aspects of the disclosures will be provided. It should be noted that the illustrative embodiment described hereinafter is merely an example and various modification may be realized without departing from the aspects of the disclosures.

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storages, hard disk drives, floppy drives, permanent storages, and the like.

Figure 1:
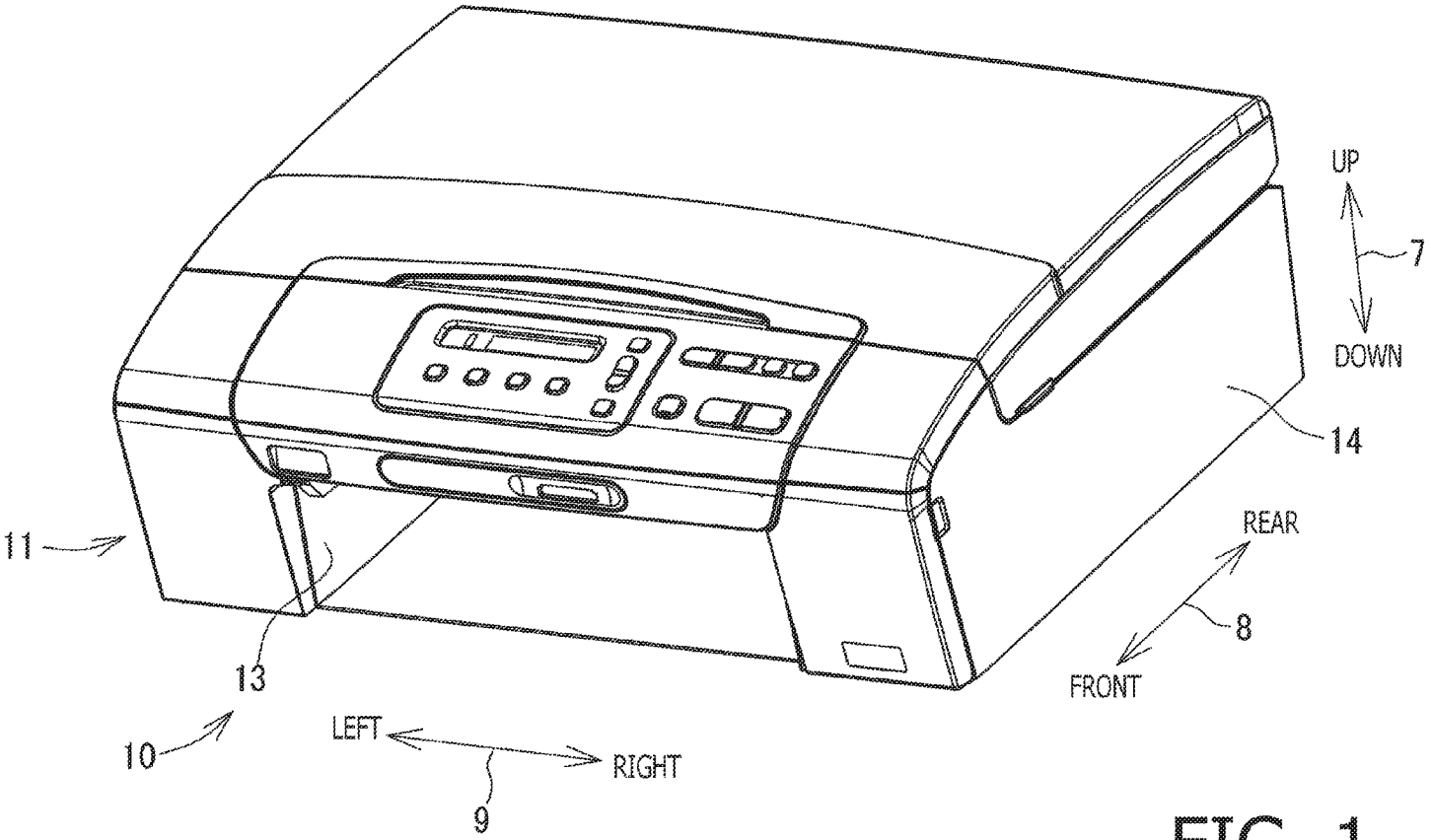
FIG. 1 is a perspective view of a multi-function peripheral according to aspects of the disclosures.

In the following description and drawings, directions will be defined such that up and down directions are defined with respect an MFP (multi-function peripheral) 10 placed for use as shown in FIG. 1. Further, a direction on which an opening 13 is formed on a casing of the MFP 10 is defined as a front side of the MFP 10, an opposite side is defined as a rear side, and right and left sides when the MFP 10 is viewed from the front side are defined as right and left sides of the MFP 10, respectively. In the following description, an up-down direction 7, a front-rear direction 8 and a right-left direction 9 are defined based on the above definitions.

The MFP 10 according to the illustrative embodiment has a printer 11 which employs an inkjet printing method, so the printer 11 is an inkjet printer. The MFP 10 according to the illustrative embodiment has multiple functions including a facsimile function, a printer function and a copier function.

<Printer 11>

As shown in FIG. 1, the printer 11 has a casing 14 which is formed with an opening 13 on a front surface thereof. Through the opening 13 on the front surface of the printer 11, a sheet tray 78 can be inserted inside the casing 14 (see also FIG. 2). The sheet tray 78 is to be inserted in/withdrawn from the opening with respect to the casing 14 in the front-rear direction 8. The sheet tray 78 supports any one of multiple sizes of printing sheets 21.

Next, referring to FIG. 2, inner configuration of the printer 11 will be described. The printer 11 has, besides the sheet tray 78 mentioned above, a sheet feeder 15 configured to feed the printing sheets 21 from the sheet tray 78, and a recording mechanism 24 which employs the inkjet recording method and print images on the printing sheets 21 by ejecting ink drops toward the printing sheets 21.

<Conveying Passage 65>

Figure 2:
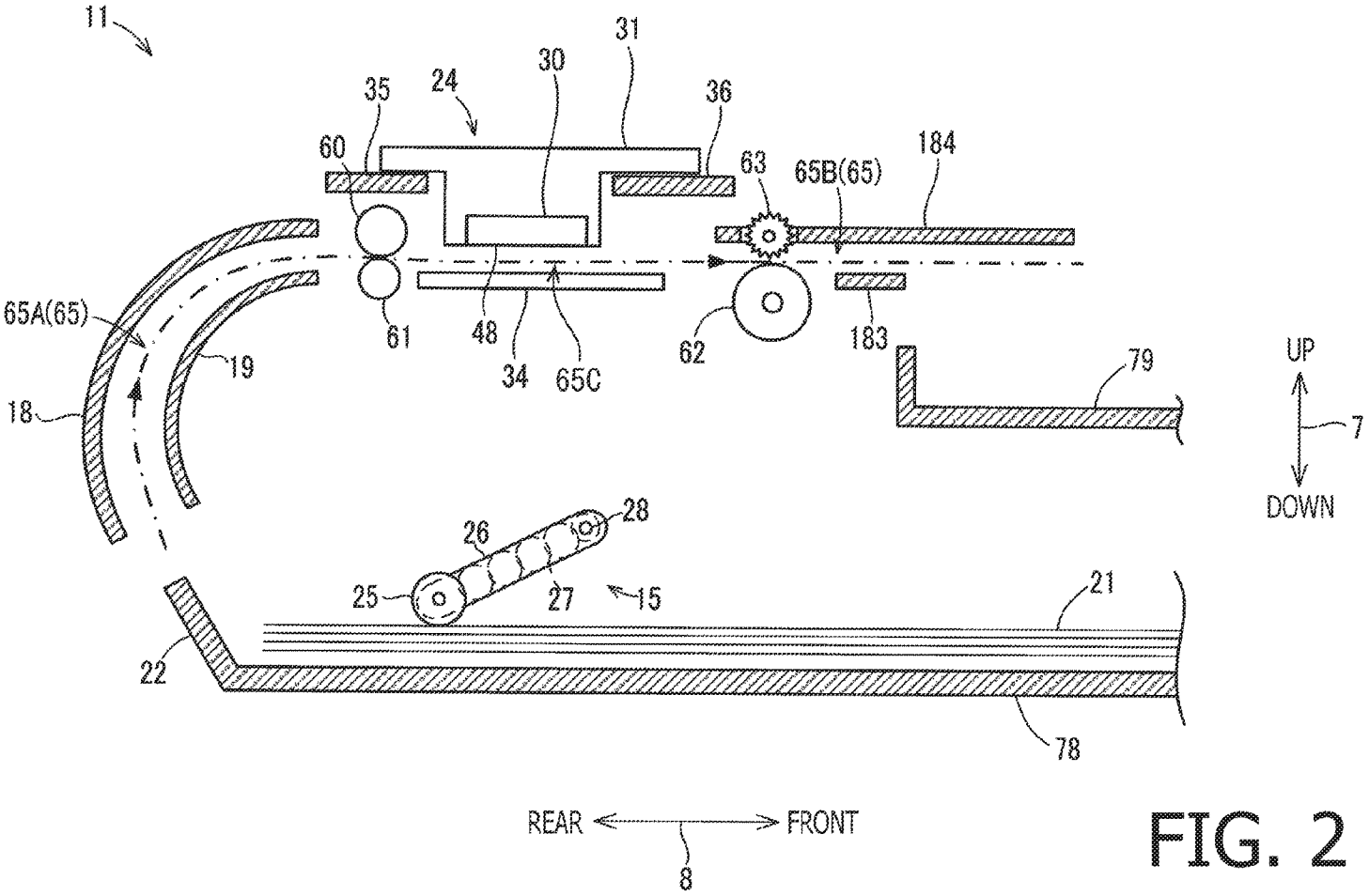
FIG. 2 is a cross-sectional side view schematically showing main components in a printer unit of the multi-function peripheral according to aspects of the disclosures.

As shown in FIG. 2, a conveying passage 65 is defined from the sheet tray 78 to the discharged sheet holder 79 through the recording mechanism 24 inside the printer 11. Specifically, the conveying passage 65 has a curved passage 65A formed between a rear end of the sheet tray 78 and the recording mechanism 24, a discharging passage 65B formed between the recording mechanism 24 and the discharged sheet holder 79, and a linear passage 65C defined between the curved passage 65A and the discharged passage 65B.

The curved passage 65A is a curved passage extending from an upper end part of an inclined part 22 which is formed on the sheet tray 78 to the recording mechanism 24. The printing sheet 21 is conveyed rearward from the sheet tray 78, and the printing sheet 21 is made a U-turn as is conveyed from a lower side to an upper side along the curved passage 65A. Thereafter, the printing sheet 21 is conveyed frontward through the linear passage 65C. The curved passage 65A is defined by an outside guide 18 and an inside guide 19 which are arranged to face with a particular distance therebetween. The discharging passage 65B is defined on a downstream side, in a conveying direction, with respect to the recording mechanism 24, and defined by a lower guide 183 and an upper guide 184 which are arranged with a particular distance therebetween. The discharging passage 65B guides the printing sheet 21 having been conveyed by the second conveying roller 62 to the downstream side, in the conveying direction.

<Sheet Feeder 15>

A sheet feeder 15 has a sheet feed roller 25, a sheet feed arm 26, and a feeding force transmission mechanism 27. The sheet feed roller 25 is arranged above the sheet tray 78. The sheet feed roller 25 is to feed the printing sheets 21 supported by the sheet tray 78 to the curved passage 65A one by one. The sheet feed roller 25 is rotatably supported at a movable end of the sheet feed arm 26. The sheet feed roller 25 is driven to rotate as a driving force of a conveying motor 76 is transmitted through the feed force transmission mechanism 27. It is noted that the feeding force transmission mechanism 27 includes multiple gears, which are rotatably supported by the sheet feed arm 26, arranged substantially linearly arranged along an extending direction of the sheet feed arm 26, and subsequently engaged, so that the rotational force is finally transmitted to the sheet feed roller 25. The sheet feed roller 25 is rotatable about an rotation shaft 28. It is noted that the sheet feed roller 25 is press-contacted, by its own weight or an urging member, on an uppermost one of the printing sheets 21 supported by the sheet tray 78. It is noted that the sheet feeder 15 is an example of a conveying mechanism set forth in the claims, and the sheet feed roller 25 is an example of a conveying-driving element, set forth in the claims, of the conveying mechanism to convey the printing sheet. Further, the conveying motor 76 is an example of a driving motor set forth in the claims.

<Recording Mechanism 24>

As shown in FIG. 2, the recording mechanism 24 is arranged above the sheet tray 78. As shown in FIGS. 2 and 4, the recording mechanism 24 has a carriage 31 which mounts the printing head 30 and is to move reciprocally in the right-left direction 9. The carriage 31 is driven to rotate as a driving force is transmitted from a carriage motor 311 (see FIG. 6). To the printing head 30, cyan ink, magenta ink, yellow ink and black ink are supplied, through ink tubes, from ink cartridges. The carriage 31 is slidably supported by guide rails 35 and 36 which extend in the right-left direction 9. With this configuration, the printing head 30 mounted by the carriage is driven to scan in the right-left direction 9 with respect to the printing sheet 21, and ejects ink drops on the printing sheet 21 which is supported on a platen 34 arranged below the printing head 30, thereby images being recorded on the printing sheet 21.

Figure 3:
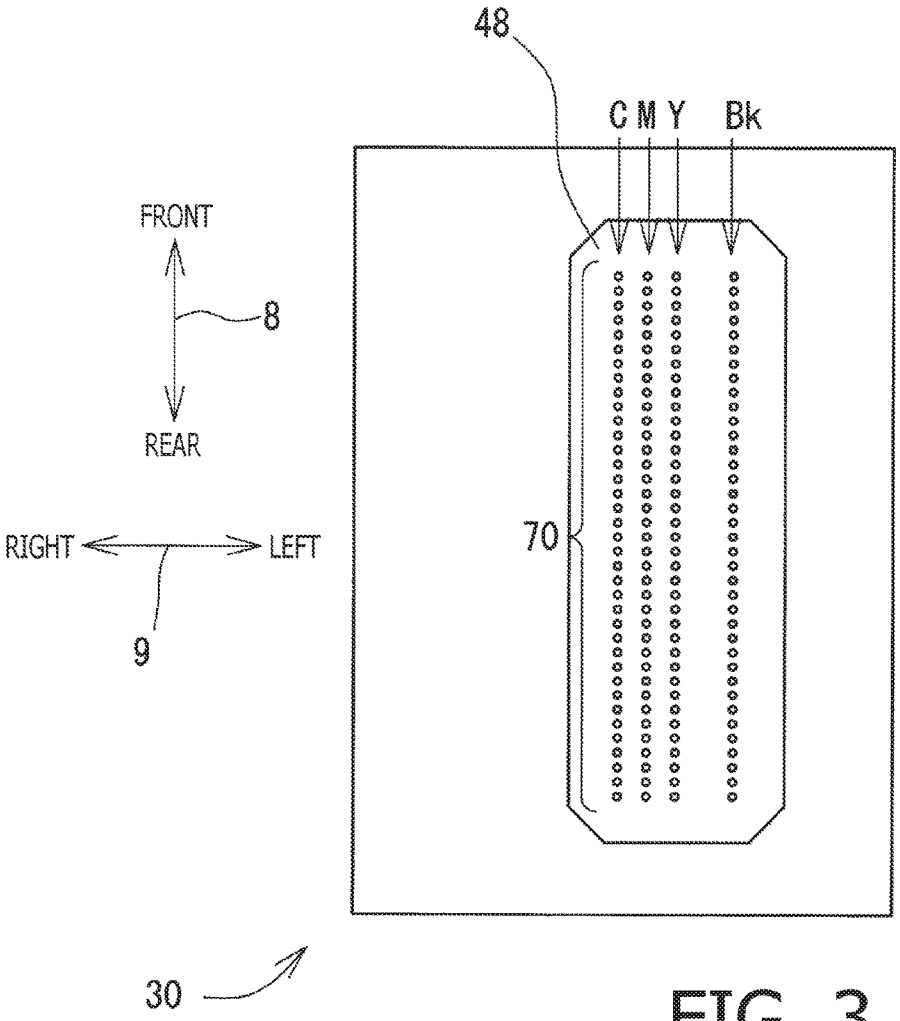
FIG. 3 is schematically shows a nozzle surface of the printing head viewed from bottom.

As shown in FIG. 2, the printing head 30 is exposed, at an under surface of the carriage 31, to downside. Further, as shown in FIG. 3, on a nozzle surface 48, which is the under surface of the printing head 30, multiple nozzles 70 are formed to eject ink drops therefrom. The nozzles are grouped for ink colors of cyan (abbreviated by letter C), magenta (abbreviated by letter M), yellow (abbreviated by letter Y) and black (abbreviated by letters BK) as shown in FIG. 3.

According to the illustrative embodiment, the nozzles 70 of each of the colors C, M, Y and BK are arranged in a line extending along the front-rear direction 8. Further, the four lines (i.e., lines for C, M, Y and BK) of nozzles are arranged in the right-left direction 9. It is noted that number of nozzles 70 and/or an arranged pitch of the nozzles 70 in each line (i.e., in the front-rear direction 8) should be designed in accordance with a resolution of an image to be formed. It is noted that, although four lines of nozzles 70 respectively corresponding to the four colors of C, M, Y and BK are formed on the nozzle surface 48 in FIG. 3, the number of lines may be modified in accordance with the number of colors to be used.

<First Conveying Roller 60 and Second Conveying Roller 62>

As shown in FIG. 2, a first conveying roller 60 and a pinch roller 61 are arranged. The first conveying roller 60 and the pinch roller 61 nip the printing sheet 21 having passed through the curved passage 65A and convey the printing sheet 21 to the platen 34. Further, on the downstream side, in the conveying direction, with respect to the position where the first conveying roller 60 and the pinch roller 61 are arranged, a second conveying roller 62 and a spur roller 63 are arranged. A passage between a position where the first conveying roller 60 and the pinch roller 61 are arranged and a position where the second conveying roller 62 and the spur roller 63 are arranged is defined as the linear passage 65C, which is defined between, in the up-down direction, the recording mechanism 24 and the platen 34. In other words, the position where the first conveying roller 60 and the pinch roller 61 are arranged is one end of the linear passage 65C, and the position where the second conveying roller 62 and the spur roller 63 are arranged is the other end of the linear passage 65C. The position where the second conveying roller 62 and the spur roller 63 are arranged is also an end of the discharging passage 65B.

The second conveying roller 62 and the spur roller 63 nip the printing sheet 21, on which an image has been recorded by the recording mechanism 24, and convey the printing sheet 21 toward the discharged sheet holder 79. The first conveying roller 60 is driven to rotate as the driving force of the conveying motor 76 is transmitted through the driving force transmitting mechanism 140. The second conveying roller 62 is rotated as the rotation force of the first conveying roller 60 is transmitted thereto. It is noted that the first conveying roller 60 and the pinch roller 61 are an example of a conveying mechanism set forth in the claims or that the first conveying roller 60, the pinch roller 61, the second conveying roller 62 and the spur roller 63 are an example of a conveying mechanism set forth in the claims.

On the carriage 31 and the guide rail 36, a linear encoder 141 is provided (see FIG. 4). Specifically, the linear encoder 141 has an encoder strip 154 extending in the right-left direction 9 and provided on the guide rail 36, and a reading head 155 mounted on the carriage 31 and readable the encoder strip 154. The reading head 155 reads an encode pattern formed on the encoder strip 154 while moving along the guide rails 35 and 36, and transmits a relative moving amount with respect to the encoder strip 154 to the controller 135 as a pulse signal.

<Maintenance Device 80>

In FIG. 4, one-dotted lines RE and LE indicate right and left ends of the printing sheet 21 having the largest width (i.e., a distance between both ends in the right-left direction of the printing sheet 21) that can be used in the printer 11. In other words, a range, in the right-left direction, between the one-dotted lines RE and LE is a passing range through which the recording sheet 21 could pass. Thus, outer ranges (i.e., ranges outside the passing range defined by lines RE and LE) are non-passing ranges where the printing sheet 21 does not pass through. It is noted that the recording mechanism 24 could move not only a range between the lines RE and LE, but could also move, in the right-left direction, beyond the passing range. A maintenance device 80 is arranged in a right side one of the non-passing ranges and within a movable range of the recording mechanism 24. In other words, the maintenance device 80 is arranged on a right end part of the movable range of the recording mechanism 24. The maintenance device 80 has a purge mechanism 44 (see FIG. 5), a waste ink tank 143 (see FIG. 9) and the like.

The purge mechanism 44 is for applying a purge operation to the recording mechanism 24. As the purge operation is applied, bubbles and foreign substances are removed by suction as well as the residual ink from the nozzles 70 of the printing head 30.

The purge mechanism 44 has a cap 46 (see FIG. 5) configured to cover the nozzles 70 of the printing head 30, a pump 143 (see FIG. 6) connected to the cap 46 to perform suction, a lift-up mechanism 55 (see FIGS. 5A and 5B) to move the cap 46 toward/away from the printing head 30, the waste ink tank 142 in which the ink and the like sucked by the pump 143 is collected, and a locking mechanism 146 (see FIG. 6) to lock the carriage 31 at a capping position P5 (see FIG. 11E) defined at the right end of the movable range.

When the lift-up mechanism 55 fully lifts the cap 46, the cap 46 closely contacts the nozzle surface 48 to cover the nozzles 70 with forming closed spaces between the cap 46 and the nozzle surface 48. Specifically, the cap 46 has two cap portions and when the cap 46 and the nozzle surface 48 closely contact each other, two closed spaces for color ink (CMK) nozzles 70 and for black ink (BK) nozzles 70 are formed. The portion of the cap 46 covering the color ink nozzles 70 will be referred to as a CO cap 144 and the portion of the cap 46 covering the black ink nozzles 70 will be referred to as a BK cap 145. On a bottom surface of each of the CO cap 144 and the BK cap 145, an intake opening is formed. Each intake opening is connected to respective ports of a ventilation mechanism 59 through tubes 163 (see FIG. 9).

The pump 143 is provided with a casing having an inner wall and a roller configured to rotate along the inner wall. A pump tube 82 is arranged between the roller and the inner wall. When the roller is driven to rotate, the pump tube 82 is squeezed and the ink inside the pump tube 82 is forced out to the waste ink tank 142. The pump 143 is driven to operate as the driving force of the conveying motor 76 is transmitted through the driving force transmitting mechanism 140 (see FIGS. 14A and 14B).

As shown in FIG. 5A, the lift-up mechanism 55 has a cap holder 90 which mounts the cap 46. The cap holder 90 has a contact lever 91 which is protruded vertically and upwardly. The lift-up mechanism 55 has right and left equal-length links 64. When the carriage 31 moves rightward toward the capping position P5, the carriage 31 pushes the contact lever 91 rightward. Then, the equal-length links 64 rotate clockwise to translate the cap holder 90 from a position shown in FIG. 5A to a position shown in FIG. 5B. When the cap 46 is located at the position shown in FIG. 5B, the cap 46 closely contacts the nozzle surface 48 of the printing head 30. The position of the cap 46 shown in FIG. 5B will be referred to as a covering position (which is an example of a cap position set forth in the claims) which corresponds to the capping position P5.

The cap holder 90 is biased by a spring 90S to move from the position shown in FIG. 5B to the position shown in FIG. 5A. Accordingly, when the carriage 31 moves leftward from the capping position P5 and the pressing force applied to the contact lever 91 is released, the equal-length links 64 rotate counterclockwise and the cap holder 90 returns to the neutral position shown in FIG. 5A, thereby the cap 46 moving away from the printing head 30. In the following description, the position of the cap 46 shown in FIG. 5A will be referred to as a separated position (which is an example of an uncap position set forth in the claims). It is noted that, as far as the cap 46 moves between the covering position and separated position in association with movement of the carriage 31, a mechanism for moving the cap 46 needs not be limited to the lift-up mechanism 55 described above. And it is noted that the lift-up mechanism is an example of a cap moving mechanism set forth in the claims.

The locking mechanism 146 is configured to lock the carriage 31 at the capping position P5. When the carriage 31 is locked at the capping position P5, a state that the carriage 31 presses the contact lever 91 is maintained, and the cap 46 stays at the covering position. The locking mechanism 146 has a locking part which is movable between a locking position at which the locking part locks (i.e., prohibits) the movement of the carriage 31 away from the capping position P5 and a non-locking position at which the locking part does not lock the movement of the carriage 31. The locking part moves periodically between the two positions as the driving force of the conveying motor 76 is transmitted through the driving force transmitting mechanism 140. It is noted that the locking of the carriage 31 by the locking part needs not be limited to a configuration which completely prevents the movement of the carriage 31, but could be one which allow the movement of the carriage 31 as long as the cap 46 is forced to stay at the covering position.

<Driving Force Transmitting Mechanism 140>

The driving force transmitting mechanism 140 has multiple gears including a planetary gear and the like as shown in FIGS. 6, 14A, 14B, 15A and 15B, and transmits the driving force of the conveying motor 76 to the first conveying roller 60 (see FIGS. 15A and 15B), the pump 143 (see FIGS. 14A and 14B), the locking mechanism 146, the sheet feed roller 25 (see FIGS. 15A and 15B), and the ventilation mechanism 59. The driving force transmitting mechanism 140 further includes a gear switching mechanism 170 (see FIG. 7) configured to switch destinations to which the driving force of the conveying motor 76 is transmitted.

The gear switching mechanism 170 shown in FIGS. 7A and 7B is arranged on the non-passing ranges where are the right side with respect to the platen 34, or on the right side with respect to the range in which the printing sheet 21 usable in the printer 11 and having the largest width can be conveyed (i.e., the area defined between the one-dotted lines LE and RE in FIG. 4). The gear switching mechanism 170 has a displaceable gear 171, four drive gears 172A-172D each of which is configured to engage with the displaceable gear 171, a pressing member 175 which is provided coaxially with the displaceable gear 171, and a lever holder 173 which holds a switching lever 176 of the pressing member 175.

The displaceable gear 171 is rotatably supported by a supporting shaft 174. The displaceable gear 171 is movable in an axial direction (i.e., the right-left direction) of the supporting shaft 174. The displaceable gear 171 is configured such that the driving force of the conveying motor 76 is transmitted to the displaceable gear 171 regardless of the location of the displaceable gear 171 in the axial direction. For this purpose, a transmission gear 76T is provided (see FIGS. 7A and 7B). The transmission gear 76T is a gear rotatable about an axis parallel to the supporting shaft 174 and the driving force of the conveying motor 76 is transmitted to the transmission gear 76T. Further, the transmission gear 76T is elongated in its axial direction so as to engage with the displaceable gear 171 regardless of the location thereof within its movable range. Further, the transmission gear 76T is fixed on a right end of the conveying roller 60.

On the right side of the displaceable gear 171, a pressing member 175 which is slidable along the supporting shaft 174. The pressing member 175 has the switching lever 176, which protrudes, through the lever holder 173, to the movable path of the carriage 31. The lever holder 173 is formed with a restriction part 173A and 173B having inclined surfaces which are allowable movement of the switching lever 176 in left direction, while prevents movement of the switching lever 176 in left direction. The lever holder 173 is further formed with another inclined part 173C which guides the switching lever 176 in a direction orthogonal to the right-left direction. Still further, the lever holder 173 has a capping surface 173D. when the carriage 31 is located at a capping position P5, the switching lever 176 pressed by the carriage 31 is located at the capping surface 173D. Furthermore, the lever holder 173 has a returning surface 173E along which the switching lever 176 located at the capping surface 173E returns to its leftmost position as shown in FIG. 7A. It is noted that the pressing member 175 and the switching lever 176 integrally move in the right-left direction, while the switching lever 176 moves relatively to the pressing member 175 in the rotational direction. It is noted that the lever holder 173 is an example of a regulation mechanism set forth in the claims.

The drive gears 172A-172D are arranged coaxially about a shaft extending in the right-left direction, and arranged below the supporting shaft 174 as shown in FIGS. 7A and 7B. the pressing member 175 is urged leftward by a spring (not shown). As shown in FIG. 7A, when the switching lever 176 is located at its leftmost position, the displaceable gear 171 is pressed leftward by the pressing member 175 and engages with the drive gear 172A (hereinafter, this state will be referred to as a first driving state).

The carriage 31 contacts the switching lever 176 when moves rightward. As the carriage 31 pushes the switching lever 176 rightward, the pressing member 175 slides rightward. It is noted that the displaceable gear 171 is urged rightward by a spring (not shown) of which urging force is weaker than a leftward urging force which the pressing member 175 receives. Accordingly, when the pressing member 175 is slid rightward, the displaceable gear 171 also moves rightward. The displaceable gear 171 engages with one of the drive gears 172A-172D depending on the location, in the right-left direction, of the displaceable gear 171. For example, when the carriage 31 is located at the capping position P5 and the nozzles 70 are covered with the cap 46, the displaceable gear 171 engages with the rightmost drive gear 172D as shown in FIG. 7B (hereinafter, this state will be referred to as a second driving state).

The conveying motor 76 is rotatable in first or second direction. The drive gears 172A-172D are configured to transmit a rotational driving force in a first or second direction, which is transmitted from the conveying motor 76 through the displaceable gear 171, to different mechanisms. A configuration of transmission of the driving force depending on whether the conveying motor 76 rotates in the first direction or the second direction will be shown in TABLE 1 below. Although the four driving gears 172A-172D are shown in FIGS. 7A and 7B, cases where the displaceable gear 171 engages with the drive gear 172B or 172C need not be described for the purpose of understanding the aspects of the present disclosures, description thereof will be omitted.

TABLE 1

| Rotation Direction of | Transmission Destination of Rotational Driving Force | |
|---|---|---|
| Conveying Motor | First Driving State | Second Driving State |
| First Direction | First Conveying Roller: Forward | First Conveying Roller: Forward<br>Movement of Locking Part<br>Switching of Ventilation Mechanism |
| Second Direction | First Conveying Roller: Reverse<br>Feeding by Feed Roller | First Conveying Roller: Reverse<br>Driving of Pump |

As shown in TABLE 1 and FIGS. 15A and 15B, in the first driving state, the driving force of the conveying motor 76 is transmitted to the first conveying roller 60 and the sheet feed roller 25. To the first conveying roller 60, the driving force of the conveying motor 76 in the first direction is transmitted. When the driving force in the first direction of the conveying motor 76 is transmitted to the first conveying roller 60, it rotates in a direction in which the printing sheet 21 is conveyed toward downstream side, in the conveying direction. Hereinafter, this rotational direction of the first conveying roller 60 will be referred to as a forward rotation. Further, when the driving force in the second direction of the conveying motor 76 is transmitted to the first conveying roller 60, the printing sheet 21 could be conveyed in a reverse direction, in the conveying direction. Hereinafter, this rotational direction of the first conveying roller 60 will be referred to as a reverse rotation. It is noted that, only the rotational driving force in the second direction is transmitted to the sheet feed roller 25. By the rotational force of the conveying motor 76 in the second direction, the sheet feed roller 25 rotates in a direction where the printing sheet 21 is fed toward the conveying passage 65.

In the second driving state, the rotational force of the conveying motor 76 is transmitted to the first conveying roller 60, the locking mechanism 146, the ventilation mechanism 59 and the pump 143 (see FIGS. 14A and 14B). the first conveying roller 60 forwardly rotates by the rotational driving force of the conveying motor 76 in the first direction, while the first conveying roller 60 reversely rotates by the rotational conveying force of the conveying motor 76 in the second direction. To the locking mechanism 146 and the ventilation mechanism 59, only the rotational driving force of the conveying motor 76 in the first direction is transmitted. The locking part of the locking mechanism 146 periodically moves between the locking position and non-locking position. The ventilation mechanism 59 periodically changes communicating status among ports to different status based on the rotation of the conveying motor 76 in the first direction (see FIGS. 14A and 14B). Further, upon rotation of the conveying motor 76 in the second direction, the pump 143 is driven to rotate.

<Ventilation Mechanism 59>

The ventilation mechanism 59 shown in FIGS. 8A-8D has a cylinder 147 having a substantially cylindrical shape, and a rotating body 148 having a substantially cylindrical shape and driven by the conveying motor 76 to rotate inside the cylinder 147. On an outer circumferential surface of the cylinder 147, a CO port 156, a BK port 157, an air communication port 158 and an air discharge port 160 are formed. Further, on an under surface of the cylinder 147, a pump connection port is formed. On an outer circumferential surface of the rotating body 148, a rib 149 made of rubber, and grooves 150 are arranged in accordance with a particular pattern. The rib 149 contacts an inner circumferential surface of the cylinder 147, and the rotating body 148 rotates with the rib 149 kept contacting the inner circumferential surface of the cylinder 147. A portion of the outer circumferential surface of the rotating body 148, a clearance is formed between the inner circumferential surface of the cylinder 147 to the outer circumferential surface of the rotating body 148. Through the clearance, the multiple ports communicate inside the ventilation mechanism 59. As the rotating body 148 rotates, a positional relationship of the rib 149 and the grooves 150 with respect to the respective ports changes, thereby communicating status among the ports is switched.

As shown by broken line in FIG. 8A, the rotating body 148 is provided with a detected member 151 which is rotatable integrally with the rotating body 148. To the detected member 151, multiple projected parts 152, which project outward in a radial direction. The multiple projected parts 152 are arranged at positions having different phases with respect to rotation of the rotating body 158. That is, the multiple projected parts 152 are spaced at particular angular intervals in the rotating direction of the rotating body 148. Further, at a position facing the outer circumferential surface of the rotating body 148, a photo sensor 153 is arranged. When the photo sensor 153 faces the projected part 152, the photo sensor 153 outputs an electrical signal indicating an ON state, while when the photo sensor 153 does not face the projected part 152, the photo sensor 153 outputs an electrical signal indicating an OFF state. Based on a period of the electrical signals indicating ON and OFF states, the controller 135 obtains a rotational phase of the rotating body 148.

As shown in FIG. 9, the CO port 156 communicates with the intake opening at the bottom of the CO cap 144 through the tube 163. The BK port 157 communicates with the intake opening at the bottom of the BK cap 145 through the tube 163. The pump connection port 159 communicates with the waste ink tank 142 through the tube 163 and the pump 143. The air communication port 158 communicates with the waste ink tank through the tube 163. Further, the air communication port 158 also communicates with atmosphere. It is noted that the discharge port 160 needs not be described for the purpose of understanding the aspects of the disclosures, description thereof will be omitted for brevity.

In accordance with the rotational phase of the rotating body 148, each of the CO port 156 and the BK port 157 communicates with the pump connection port 159. For example, in a CO suction state (see FIG. 8A), one of the grooves 150 is located to face the CO port 156. Each the grooves 150 is formed on the rotating body 148 in the up-down direction (i.e., a direction orthogonal to a plane of FIGS. 8A-8D), and each of the grooves 150 reaches the pump connection port 159 formed on the bottom surface of the cylinder 147. Thus, in the CO suction state, the CO port 156 communicates with the pump connection port 159 through the grooves 150. In this state (i.e., the CO suction state), the controller 135 drives the pump 143 to make a space between the CO cap 144 at the covering position and the nozzle surface 48 be in a negative pressure condition. With this configuration, the ink resides at the nozzles 70 of the color (CMK) ink and/or the on the nozzle surface 48, air bubbles and foreign substances are sucked toward the pump 143, and sent to the waste ink tank 142. This is an operation called as the purge operation, and executed to maintain a state that the ink drops are normally ejected from the nozzles 70 of the printing head 30.

Further, in accordance with the rotational phase of the rotating body 148, each of the CO port 156 and the BK port 157 communicates with the air communication port 158. For example, in an air communication state (see FIG. 8C), the rib 149 does not block communication among the CO port 156, the BK port 157 and the air communication port 158 (i.e., they are communicate with each other). That is, the space between the BK cap 145 and the nozzle surface 48 or the space between the CO cap 144 and the nozzle surface 48 communicates with atmosphere through the air communication port 158.

If the cap 46 moves to the covering position in this state, at a point of time when the cap 46 closely contacts the nozzle surface 48, the air between the cap 46 and the nozzle surface 48 is discharged outside through the air communication port 158. That is, it is prevented that the space between the cap 46 and the nozzle surface 48 becomes in a pressurized state. In order to prevent meniscus of the ink formed in each nozzle 70 from damaged, the controller 135 switches the ventilation mechanism 59 to the air communication state before the carriage 31 is moved to the capping position P5. This operation will be described in detail later.

<Controller 135>

The controller 135 shown in FIG. 6 is configured to control the entire operation of the MFP 10. The controller 135 has a microcomputer provided mainly with a CPU (central processor), a ROM (read only memory), a RAM (random access memory), an EEPROM (electrically erasable ROM) and an ASIC (application specific integrated circuit).

The ROM stores programs which cause, when executed by the CPU, the MFP 10 to execute various operations. The RAM is used as a temporary storage area in which data and signals the CPU uses when executing the programs, and is also used as a work area used for data processing and the like. The EEPROM stores various settings and flags, which are retained even after a power off of the MFP 10.

As shown in FIG. 6, the controller 135 is connected with the conveying motor 76, the carriage motor 311, the reading head 155, the printing head 30, the photo sensor 153. The controller 135 is configured to control rotation of the conveying motor 76 and carriage motor 311 via the ASIC. Further, to the controller 135, signals output by the reading head 155 and the photo sensor 153 are transmitted through the ASIC.

The controller 135 calculates a movement distance and a current position of the carriage 31 based on the number of pulses of the pulse signal generated by the reading head 155. The controller 135 determines a target position to which the carriage 31 is moved based on the number of pulses of the pulse signal generated by the reading head 155. It is noted that, a moved amount of the carriage 31 is known based on the number of pulses. Therefore, a reference position is defined within the movable range of the carriage 31, and the obtained number of pulses is accumulated, the position of the carriage 31 with respect to the reference position is obtained. According to the illustrative embodiment, position LE (see FIG. 4) is used as the reference position and the current position of the carriage 31 is obtained as a distance from the position LE.

The photo sensor 153 generates a signal (a voltage signal or a current signal) in accordance with the intensity of the light received by a light receiving element. The thus generated signal is transmitted to the controller 135. The controller 135 then determines whether a level (i.e., voltage or current) of the signal generated by and transmitted from the light receiving element (hereinafter, the signal is also referred to as an input signal) is equal to or greater than a particular threshold value. When the amplitude of the input signal equal to or greater than a particular threshold value, the controller 135 determines the input signal as a HIGH level signal, while the amplitude of the input signal is less than the particular threshold value, the controller 135 determines the input signal as a LOW level signal. The controller 135 detects a rotation amount and a rotational phase of the rotating body in the ventilation mechanism 59 based on the number of times or based on the number of pulses of the pulse signals at which the HIGH level signal and the LOW level signal are switched.

<Capping Process>

Next, referring to a flowchart show in FIG. 10, a capping process in which the controller 135 causes the carriage 31 to move to the capping position P5, and causes the locking mechanism 146 to lock the carriage 31 will be described.

When a job of recording images is finished, the controller 135 executes the capping process shown in FIG. 10. In the capping process, the controller 135 causes the carriage 31 to stay (i.e., standby) at a position around a position where the printing head 30 lastly ejects the ink drops in the preceding print job. At this stage, the printing sheet 21 is discharged onto the discharge sheet holder 79 (S10). After S10, the controller 135 pauses for five seconds (S20) with keeping the carriage 31 in the standby state (i.e., stopped state). When the controller 135 does not receive the next image recording job within the five seconds, the controller 135 executes a process to control the carriage motor 311 to move the carriage 31 to the capping position P5.

The process, executed by the controller 135, to control the carriage motor 311 to move the carriage 31 to the capping position will be described in detail. Firstly, the controller 135 causes the carriage 31 to move rightward toward the capping position P5 at the particular speed (S30). The controller 135 keeps moving the carriage 31 toward the capping position P5 until the controller 135 detects that the carriage 31 has reached a fractional movement start position P1 (see FIG. 11A) based on the pulse signal generated by the reading head 155. The fractional movement start position P1 is defined at a right side position within the range in which the carriage 31 moves for recordation of images. According to the illustrative embodiment, the position RE may be defined as the fractional movement start position P1. It is noted that the switching lever 176 of the gear switching mechanism 170 and the contact lever 91 of the lift-up mechanism 55 are provided within the movement passage of the carriage 31. In other words, the fractional movement start position P1 is a position where the carriage 31 is spaced leftward from the position of the contact lever 91 and the position of the switching lever 176 at the first driving state. At this stage, the gear switching mechanism 170 is in the first driving state, which is an image recording state.

Next, the controller 135 switches the movement operation of the carriage 31 to the fractional movement operation (S50). It is noted that the term "fractional movement" in this specification means that the carriage 31 continuously repeats moving a fractional distance (e.g., a distance corresponding to the resolution of the encoder strip 154, for example, 1/150 inch). Specifically, the controller 135 sets a target position of the carriage 31 at a 1/150 inch ahead in response to the reading head 155 generating the pulse signal (e.g., a rising-up of the pulse signal at the target position). At this stage, the controller 135 once reduces an operating amount (e.g., a voltage value or a current value) to be transmitted to the carriage motor 311 to a particular value. Thereafter, the controller 135 increases the operation amount transmitted to the carriage motor 311. When the carriage 31 has reached the target position, the controller 135 temporarily reduces the operation amount to be transmitted to the carriage motor 311 to the particular amount. Next, another target position is set at a position 1/150 inch ahead in a similar manner. Then, the controller 135 increases the operation amount to be transmitted to the carriage motor 311. By repeating the above to execute the fractional movement of the carriage 31 so that the carriage 31 can be stopped at the target position more accurately. Further, a moving speed (i.e., average moving speed) is less than the moving speed when the image is recorded. It is noted that as long as the average speed of the carriage 31 is reduced, another method of controlling the movement speed of the carriage motor 311 may be employed. The controller 135 causes the carriage 31 to execute the fractional movement operation. Further, the controller 135 causes the carriage 31 to keep executing the fractional movement until a stoppage operation (e.g., S110, S130 and S170) is executed.

As the fractional movement is executed, the carriage 31 further moves rightward and has finally reached the switching lever contact position P2 (see FIG. 11B). At this stage, the switching lever 176 contacts a protruded part, which is protruded rearward. Even after the carriage 31 has reached the position P2, the controller 135 continues the fractional movement of the carriage 31. Thus, the switching lever 176 is moved rightward as pressed by the carriage 31.

Next, the controller 135 keeps moving the carriage 31 until the controller 135 detects that the carriage 31 has reached a drive switch position P3 (see FIG. 11C) based on the signal output by the reading head 155 (S60: NO). When the controller 135 detects that the carriage 31 has reached the drive switch position P3 (S60: YES), the controller 135 executes process in S70. When the carriage 31 is located at the drive switch position P3, the switching lever 176 has been moved rightward as pressed by the carriage 31 and has passed the regulation part 173A. At this stage, leftward movement of the switching lever 176 is restricted, the displaceable gear 171 is not necessarily located at a position where displaceable gear 171 is engageable with the drive gear 172D. It is because there may occur a case where the threads of the displaceable gear 171 and the threads of the drive gear 172D interfere with each other. Further, at the drive switch position P3, the contact lever 91 contacts the right end of the carriage 31. The controller 135 executes a fractional reciprocation of the conveying motor 76 in S70. That is, in S70, the controller 135 switches a rotation direction of the conveying motor 76 at ever fractional period (e.g., 0.1 seconds). According to the illustrative embodiment, the controller 135 executes the fractional reciprocation (i.e., switching the rotation direction at every fractional period) about ten times. By this fractional reciprocation operation, even if the side surfaces of the teeth of the displaceable gear 171 and the side surfaces of the teeth of the drive gear 172D interfere with each other, since the displaceable gear 171 is angularly shifted with respect to the drive gear 172D, it is ensured that the displaceable gear 171 and the drive gear 172D engage with each other.

After the fractional reciprocation, the controller 135 rotates the conveying motor 76 in the first direction, thereby driving the ventilation mechanism 59, that is, rotating the rotating body 148 (S80). At a time when the rotating body 148 starts rotating, the ventilation mechanism 59 is in a state shown in FIG. 8B, which is an image recording state. In the image recording state, the rib 149 is located between the CO port 156 and the air communication port 158. Thus, the CO port 156 is not connected with the atmosphere. When the conveying motor 76 rotates in the first directions, the rotating body 148 rotates in a clockwise direction (in FIG. 8B). The controller 135 keeps rotating the conveying roller 76 in the first direction until the ventilation mechanism 59 becomes in the air communicating state (see FIG. 8C). It is noted that this operation is executed in parallel with movement of the carriage 31. Although not shown in the flowchart, the controller 135 stops rotation of the conveying motor 76 when the ventilation mechanism 59 is switched to the air communication state. According to the illustrative embodiment, the controller 135 detects switching of the ventilation mechanism 59 into the air communicating state based on the signal generated and output by the photo sensor 153.

The controller 135 keeps moving the carriage 31 until it is detected that the carriage 31 has reached an idle suction position P4 (see FIG. 11D) (S80: NO) based on the signal generated by the reading head 155. When the controller 135 detects that the carriage 31 has reached position P4 (S90: YES), the controller 135 executes S100 which will be described later. At the idle suction position P4, the contact lever 91 has been moved rightward by a particular distance by the carriage 31. However, the contact lever 91 has not been moved to a right end of its movable range. At this stage, by the movement of the contact lever 91, the cap 46 has been moved immediately before the covering position. Further, the cap 46 has not been completely contacted with the nozzle surface 48 of the printing head 30, and there is a clearance between the nozzle surface 48 and the cap 46. The idle suction position P4 is a position of the carriage 31 at which the carriage 31 can suck the ink or the like resides in the cap 46 by driving the pump 143 without sucking the ink from the nozzles 70.

At the idle suction position P4, if the ventilation mechanism 59 has not switched to the air communicating state (S100: NO), the controller 135 stops moving the carriage 31 (S110). Further, if the controller 135 detects, based on the signal output by the reading head 155, the position the carriage 31 actually stops is a position beyond a boundary position Pb (see FIG. 11D) defined at a right side with respect to the idle suction position P4 (S120: YES), the controller 135 causes the carriage 31 to move leftward and to stop the carriage 31 at the idle suction position P4 (S130). If the controller 135 detects that the position at which the carriage 31 actually stops is not beyond the boundary position Pb (S120: NO), the controller 135 maintains the stopped state of the carriage 31. It is noted that the boundary position Pb is a position defined between the idle suction position P4 and the capping position P5. When the carriage 31 is located at the boundary position Pb, a part of the cap 46 contacts the nozzle surface 48. It is noted that, the boundary position Pb according to the illustrative embodiment is defined as above. However, it can be modified and the boundary position Pb may be any position between the idle suction position P4 and the capping position P5.

In a state where the carriage 31 is stopped, if the ventilation mechanism 59 is not switched to the air communication state (S140: NO), the controller 135 rotates the conveying motor 76 until the ventilation mechanism 59 is switched to the air communication state. If the ventilation mechanism 59 is switched to the air communication state (S140: YES), the controller 135 re-start the fractional movement of the carriage 31 (S150).

When the carriage 31 has reached the idle suction position P4, if the ventilation mechanism 59 has been switched to the air communication state (S100: YES), the controller 135 continues the fractional movement of the carriage 31.

Until the controller 135 detects that the carriage 31 reaches the capping position P5 (see FIG. 11E) based on the signal generated by the reading head 155, the controller 135 causes the carriage 31 to move (S160: NO). When the controller 135 detects that carriage 31 has reached the capping position P5 (S160: YES), the controller 135 stops moving the carriage 31 (S170). It is noted that when the carriage 31 is located at the capping position P5, the carriage 31 is located at the right end within its movable range. Further, the contact lever 91 is located at the right end within its movable range by the carriage 31. With this configuration, the cap 46 has been moved to the covering position, and closely contacts with the nozzle surface 48. Further, the switching lever 171 contacts the cap surface 173C.

Next, the controller 135 rotates the conveying motor 76 in the first direction again, and switches the state of the ventilation mechanism 59 from the air communication state to the locking state (FIG. 8D) (S180). It is noted that the rotational phase of the rotating body 148 corresponds to the location of the locking part. When the ventilation mechanism 59 is in the locking state, the locking part is located at the locking position and locks the carriage 31 (i.e., prevents movement of the carriage 31).

FIGS. 12A-12C show change of the state of the locking part, the CO port 156 and the BK port 157 in accordance with the rotational phase of the rotating body 148. Further, FIGS. 12A-12C show the rotational phases of the rotating body 148 in the CO suction state A, the image recoding state B, the air communication state C and the locking state D. It is noted that the rotational phases of the rotating body 148, the states of the locking part, the CO port 156 and the BK port 157 need not be limited to those shown in FIGS. 12A-12C, and can be modified in accordance with necessity.

As shown in FIGS. 12A-12C, since the air communication state C is a state immediately before the locking part moves to the locking position, a rotation angle of the rotating body 148 from the air communication state C to the locking state D is small. In other words, the ventilation mechanism 59 and the locking mechanism 146 are configured so that switching from the air communication state C to the locking state D can be switched in a small period of time.

According to the illustrative embodiment, while the carriage 31 is moving to the capping position at which the cap 46 covers the nozzle surface 48, when the carriage 31 has reached the fractional movement start position P1, the controller 135 starts the fractional movement of the carriage 31. When the carriage 31 proceeds in accordance with the fractional movement and reaches the drive switching position P3, the controller 135 executes the fractional reciprocation to ensure engagement between the displaceable gear 171 and the drive gear 172D with maintaining the fractional movement of the carriage 31. Thereafter, the controller 135 drives the ventilation mechanism 59 to switch to the air communicating state. That is, according to the illustrative embodiment, the fractional movement of the carriage 31 and switching of the ventilation mechanism 59 can be executed simultaneously. Therefore, at the capping position P5, a time necessary for the cap 46 to cover the nozzle surface 48 can be shortened. Further, since the carriage 31 reaches the capping position P5 in accordance with the fractional movement, damage of the meniscus formed in the nozzles 70 can be prevented.

Further, the carriage 31 is to wait at a position between the idle suction position P4 and the capping position P5 until the ventilation mechanism 59 becomes the air communication state. Therefore, it will not occur that the carriage 31 reaches the capping position P5 to perform capping before switching of the ventilation mechanism 59 has completed. That is, damage of meniscus formed on the nozzles can be prevented on one hand. On the other hand, if switching of the ventilation mechanism 59 has been completed before the carriage 31 reaches the idle suction position P4, the controller 135 make the carriage 31 reach the capping position P5 without making the carriage 31 wait at the idle suction position P4.

If a stop position of the carriage 31 has passed the boundary position Pb on the capping position side P5 before switching of the ventilation mechanism 59 has finished, the carriage 31 is to return the idle suction position P4. That is, the fractional movement operation is re-started at the idle suction position P4, possibility that meniscus is damaged is further reduced. If the stop position of the carriage 31 is a position between the idle suction position P4 and the boundary position Pb, the controller 135 maintains stoppage of the carriage 31.

When the CO port 156 and the BK port 157 are communicate with the air communication port 158, and the locking part is located at the position immediately before moving to the locking position, the conveying motor 76 is rotated in the first direction. Therefore, a rotation amount of the conveying motor 76 necessary for moving the locking part to the locking position after capping is reduced. That is, the carriage 31 and the time necessary for capping is reduced, and further, the carriage 31 can be locked quickly.

Further, by shifting the position of the teeth of the displaceable gear 171 with the fractional reciprocation, engagement between the displaceable gear 171 and the drive gear 172D is ensured before the ventilation mechanism 59 is driven. Since the fractional reciprocation and/or switching of the ventilation mechanism 59 are executed during the fractional movement of the carriage 31, a time period necessary for the capping operation can be shortened.

<Image Recording Job Generated after Completion of Standby Process>

Next, referring to FIG. 13, a control by the controller 135 when an image recording job after completion of the standby process will be described. The process shown in FIG. 13 is executed as an interruption process, which is invoked when the standby process is started. It is noted that the standby process is processes of S10 and S20 of the flowchart shown in FIG. 10. Firstly, the controller 135 pauses for five seconds (S20) in a state where the carriage 31 is stopped (S10) in the vicinity of a position at which the printing head 30 lastly ejects the ink drops in the previous job. If a next image recording job is not occurred during the five-second pause, the controller 135 terminates the standby process (S200), and controls the carriage motor 311 and executes a control to move the carriage 31 to the capping position P5 (S30). Thereafter, when the next image recording job is generated (S210: YES), the controller 135 determines whether a locking process (which is a process executed by the controller 135 at S180 (in FIG. 10)) has completed (S220). When the locking process has completed (S220: YES), the controller 135 release the lock (S230) by rotating the conveying motor 76 to release the ventilation mechanism 59 from the locked state (FIG. 8D).

Next, the controller 135 controls the carriage motor 311 to move the carriage 31 leftward, toward a printing area (S240). With this movement of the carriage 31, the contact lever 91 located at the right end of its movable range by the carriage 31 returns leftward, thereby the cap holder 90 being returned to its neutral position. Accordingly, the cap 46 is moved from the covering position to the separated position. Further, since the carriage 31 moves leftward, contacting of the carriage 31 with respect to the switching lever 176 is released. Then, the pressing member 175 tends to move leftward by the urging force. However, the switching lever 176 is allowed to move leftward without being restricted by the regulation part 173A and moving along a returning surface 173E. Accordingly, the pressing member 175 also returns leftward without being restricted. According to the above configuration, the pressing member 175 pushes the displaceable gear 171 leftward, and the displaceable gear 171 engages with the drive gear 172A. Then, it becomes possible that the rotational force of the conveying motor 76 is transmitted to the sheet feed roller 25, and feeding of the printing sheet becomes possible. Next, the controller 135 determines whether a carriage movement process has been completed in S300. When the carriage movement process has been completed, the carriage is beyond the fractional movement start position P1 rightward. When the carriage movement process has been completed (S300: YES), the controller 135 executes the engagement enabling process (S310). At this stage, the controller 135 executes the fractional reciprocation to ensure engagement of the displaceable gear 171 with the driving gear 172A, and starts a next image recording (S320).

When the controller 135 determines that the carriage movement process has not been completed (S300: NO), the controller 135 starts executing the next image recoding process without executing S310.

When the locking process has not been executed (S220: NO), the controller 135 determines whether the capping process has been completed (S260). When it is detected that the capping process has been completed (S260: YES), the controller causes the carriage 31 to move leftward to the printing area (S240). With this configuration, process can be moved to the next image recordation quickly since the locking process and lock-releasing process are not executed (S230).

When it is determined that the capping process has not be completed (S260: NO), the controller 135 determines whether the air communication switching process by the ventilation mechanism 59 has completed (S270). When it is determined that the air communication switching process has been completed (S270: YES), the controller 135 executes the capping process (S280). Then, the controller 135 causes the carriage 31 to move leftward to the printing area (S240). With this configuration, process can be moved to the next image recordation quickly since the locking process and lock-releasing process are not executed (S230).

When the controller 135 determines that the air communication switching process has not been completed (S270: NO), the controller 135 determines whether the engagement enabling process has been completed (S290). When it is determined that the engagement enabling process has been completed (S290: YES), the controller 135 executes the capping process (S280). Then, the controller 135 executed leftward movement of the carriage 31 to the printing area (S240). With this configuration, process can be moved to the next image recordation quickly since the locking process and lock-releasing process are not executed (S230).

When it is determined that the engagement enabling process has not been completed (S290: NO), the controller 135 causes the carriage 31 to move leftward to the printing area.

<Modifications>

According the above-describe illustrative embodiment, the displaceable gear 171 engages with the drive gear 172D, and the contact lever 91 contacts the right end of the carriage 31 at the drive switching position P3. This configuration may be modified such that a position at which the displaceable gear 171 engages with the drive gear 172D and a position at which the contact lever 91 contacts the right end of the carriage 31 are different positions.

It is noted that the ventilation mechanism 59 may have more ports, and communicating states among the ports may be control in a more detailed manner. Alternatively, the ventilation mechanism 59 may be configured only to make the CO port 156 and the BK port 157 communicate with an external space (e.g., atmosphere) or block the communication. Further, the configuration of the pump 143 needs not be limited to the one described above, but any suitable configuration may be employed.

It is noted that the gear switching mechanism 170 needs not to switch the driving states in accordance with the configuration described above. For example, the first driving state and the second driving state may be switched with use of a motor dedicated for the switching which may be driven by the controller 135 by detecting whether the carriage 31 has reached the drive switching position P3. Further, the gear switching mechanism 170 may have more drive states.

It is noted that the fractional reciprocation operation is necessary in a case where side surfaces of the teeth of the displaceable gear 171 and the drive gear 172D (or 172A, 172B, 172C) may interfere with each other when a location of the displaceable gear 171 is changed. If the side surfaces of the teeth of the displaceable gear 171 and the drive gear 172D (or 172A, 172B, 172C) are configured not to interfere with each other even when the location of the displaceable gear 171 is changed, the fractional reciprocation operation may not be necessary. That is, if the gears (which are the displaceable gear 171 and the drive gear 172D (or 172A, 172B, 172C)) are configured such that side surfaces of the teeth of the displaceable gear and the drive gear are configured not to interfere with each other, S70 in FIG. 10, S290 and S310 in FIG. 13 may be omitted. Further, if the gears are configured so that the fractional reciprocation operation is unnecessary, the displaceable gear 171 may move in accordance with movement of the switching lever 176. In such a case, an urging force directed from the left to right applied to the displaceable gear 171 may also become unnecessary.

According to the illustrative embodiment, the number of the drive gears are more than two (i.e., there are four drive gears 172A, 172B, 172C and 172D in the embodiment). However, the number of the drive gears needs not be limited to such a number. For example, the drive gears may be only two (e.g., the drive gears 172A and 172D). According to the illustrative embodiment, more than two drive gears are provided and the lever holder 173 has a regulation part 173A which allows rightward movement of the switching lever 176, while prevented leftward movement thereof. In a modified embodiment which has only two drive gears, the regulation part may be omitted.

It is noted that the above-described illustrative embodiment and modifications are only illustrative examples, and various modifications could further be obtained without departing the gist of the disclosures.

What is claimed is:

1. An inkjet printer, comprising:

a printing head configured to eject ink drops from multiple nozzles;

a conveying mechanism configured to convey a sheet;

a carriage mounting a printing head and configured to be reciprocally movable in a particular direction and movable within both a printing area at which the printing head faces the sheet conveyed by the conveying mechanism and a non-printing area outside the printing area in the particular direction;

a cap moving mechanism arranged in the non-printing area and configured to move a cap capable of covering the multiple nozzles formed on the printing head between a capping position at which the cap covers the multiple nozzles and an uncap position at which the cap does not cover the multiple nozzles;

a controller configured to control movement of the carriage, wherein the controller is configured to execute:

a printing process in which the controller causes the carriage to move within the printing area;

a standby process in which the controller causes the carriage to stop within the printing area for a particular period after a printing operation is finished and causes the carriage to wait until receipt of a next printing command;

a carriage moving process in which the controller causes the carriage to move in a first direction, which is a direction from the printing area to the non-printing area in the particular direction, toward the cap moving mechanism when the next printing command has not been received within the particular period of the standby process; and a capping process in which the controller causes the cap to move from the uncap position to the capping position, the capping process being executed after the carriage moving process, wherein the controller causes the carriage to move in a second direction opposite to the first direction without executing the capping process when the next printing command is received after the carriage moving process has started and before the carriage moving process has been completed.

2. The inkjet printer according to claim 1, further comprising:

a driving motor; and a driving force transmitting mechanism arranged in the non-printing area and configured to switch destinations to which the driving force of the driving motor is to be transmitted, wherein the driving force transmitting mechanism has:

a displaceable gear which is movable in the particular direction with being in a state where the driving motor can be transmitted to the displaceable gear, the displaceable gear being urged in the first direction; and multiple drive gears arranged along the particular direction so as to be engageable with the displaceable gear, the multiple drive gears including a first drive gear configured to transmit a driving force to a conveying element and a second drive gear arranged on the first direction side with respect to the first drive gear;

a pressing member arranged to be movable in the particular direction, the pressing member being arranged on the first direction side with respect to the movable gear, the pressing member being urged in the second direction so that the pressing member presses to urge the displaceable gear in the second direction with an urging force which is stronger the urging force of the displaceable gear in the first direction, the pressing member being movable in the first direction in association with movement of the carriage in the first direction; and a regulation mechanism configured to regulate movement of the pressing member, the regulation mechanism allowing movement of the pressing member in the first direction when the pressing member is located at a second position which is on the first direction side with respect to a first position at which the pressing member presses the displaceable gear in the second direction to make the displaceable gear engage with the first drive gear, the regulation mechanism preventing movement of the displaceable gear in the second direction, the regulation member allowing movement of the pressing member located at a third position which is on the first direction side with respect to the second position to move in the second direction to return the first position, the displaceable gear being movable to a position at which the displaceable gear is engageable with the second drive gear, by the urging force in the first direction, when the pressing member is located at the second position.

3. The inkjet printer according to claim 2, wherein the controller is further configured to execute an engagement enabling process in which the controller drives the driving motor such that rotation direction of the displaceable gear is fractionally alternated to make the displaceable gear and the second driving gear engage with each other after the carriage moving process and before the capping process.

4. The inkjet printer according to claim 3, wherein the controller is further configured to execute the engagement enabling process after movement of the carriage in the second direction has been completed.

* * * * *